US009820547B2

(12) United States Patent
Yamasaki

(10) Patent No.: US 9,820,547 B2
(45) Date of Patent: Nov. 21, 2017

(54) DRAWING DEVICE AND DRAWING METHOD OF THE SAME

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/099,355

(22) Filed: Apr. 14, 2016

(65) Prior Publication Data

US 2016/0374448 A1 Dec. 29, 2016

(30) Foreign Application Priority Data

Jun. 25, 2015 (JP) ..... 2015-127624

(51) Int. Cl.

| | |
|---|---|
| ***G06K 15/22*** | (2006.01) |
| ***A45D 29/00*** | (2006.01) |
| ***A45D 44/00*** | (2006.01) |

(52) U.S. Cl.

CPC ..... *A45D 29/00* (2013.01); *A45D 44/005* (2013.01); *A45D 2029/005* (2013.01)

(58) Field of Classification Search

None

See application file for complete search history.

(56) References Cited

U.S. PATENT DOCUMENTS

| | | | | |
|---|---|---|---|---|
| 3,582,955 | A * | 6/1971 | McMurray | G09G 1/26 346/17 |
| 4,757,330 | A * | 7/1988 | Onozato | G01D 15/22 346/139 R |
| 6,286,517 | B1 * | 9/2001 | Weber | A45D 29/00 132/200 |
| 2003/0219923 | A1 * | 11/2003 | Nathan | H01L 51/0021 438/99 |
| 2012/0274683 | A1 * | 11/2012 | Yamasaki | B41J 3/4073 347/2 |
| 2012/0287183 | A1 * | 11/2012 | Bitoh | A45D 29/00 347/3 |
| 2014/0060560 | A1 * | 3/2014 | Bitoh | A45D 29/00 132/73 |

(Continued)

FOREIGN PATENT DOCUMENTS

JP 2003534083 A 11/2003

*Primary Examiner* — Ted Barnes

(74) *Attorney, Agent, or Firm* — Holtz, Holtz & Volek PC

(57) ABSTRACT

A drawing device includes a drawing unit holding a drawing tool for drawing on a drawing target surface in contact with the drawing target surface having a curved shape along a first direction and moving the drawing tool; and a control unit controlling the drawing unit.

The control unit controls the drawing unit to perform an operation in which the drawing tool moves on a first and second regions adjacent in the first direction of the drawing target surface along a second direction crossing with the first direction in a state in which the drawing tool is in contact with the drawing target surface, then drawing tool draws on the first and second regions, and an operation in which the drawing tool moves between the first and second regions in a state in which the drawing tool is separated from the drawing target surface.

8 Claims, 11 Drawing Sheets

(56) References Cited

U.S. PATENT DOCUMENTS

| | | | | |
|---|---|---|---|---|
| 2014/0132968 | A1* | 5/2014 | Bitoh | A45D 29/00 358/1.6 |
| 2014/0168668 | A1* | 6/2014 | Nakajima | B41J 3/4073 358/1.6 |
| 2014/0232802 | A1* | 8/2014 | Bitoh | B41J 2/49 347/110 |
| 2015/0020834 | A1* | 1/2015 | Bitoh | A45D 29/00 132/200 |
| 2015/0027480 | A1* | 1/2015 | Bitoh | A45D 29/00 132/200 |
| 2015/0128981 | A1* | 5/2015 | Asako | A45D 29/00 132/200 |
| 2015/0138275 | A1* | 5/2015 | Noell | B41J 3/4073 347/37 |

* cited by examiner 1
2
10
11
12
13
23
26
30
32
40
41
43
44
45
46
47
48
50
51
52
53
71
111
112
113a
113b
114
115
116
31
31f
31g
451
471
T
U1
U2
Y
II

DRAWING DEVICE AND DRAWING METHOD OF THE SAME

CROSS-REFERENCE TO RELATED APPLICATIONS

Corresponding Japanese application
Application Number: Patent Application Number 2015-127624, Date of Application: Jun. 25, 2015

BACKGROUND OF THE INVENTION

1. Field of the Invention

The present invention relates to a drawing device and a drawing method for the drawing device.

2. Description of the Related Art

Conventionally, a nail printer is known which prints a favorite nail design on a finger nail. Such a nail printer is, for example, disclosed in JP 2003-534083 W.

By using such a device, a user can easily enjoy nail printing without using a nail salon.

Conventionally, a plotter type drawing device is known which includes a pen for drawing and performs drawing by coming into contact with a pen tip on a paper, and such a drawing device is considered to be used as a nail printer.

In the case where drawing is performed by a pen, in comparison with an ink jet type printer, an ink having high viscosity and ink including such as a color material having high viscosity and ink including a color material having a large particle diameter can be used for drawing. Therefore, a variation of a nail design which can be drawn is increased by a nail printer.

However, in the case where a plotter type drawing device is used as a nail printer, a drawing target is a nail having a curved shape. Therefore, when a drawing position is changed, a surface with which a pen tip is in contact is changed in a vertical direction (a height direction) depending on the curved shape of a nail.

Herein, in the case where drawing is performed from an end of a nail having a relatively low height to a center of the nail having a relatively high height (specifically, in a case where a pen climbs an inclined surface), a nail may be strongly pushed in a horizontal direction by the pen. When the nail is strongly pushed by the pen as described above, a finger may move accordingly. If a finger moves during drawing, finishing quality of a nail print is lowered.

BRIEF SUMMARY OF THE INVENTION

An advantage of the present invention is to provide a drawing device and a drawing method for the drawing device, and the drawing device can perform highly fine drawing by reducing that a nail is pushed in a width direction of the nail by a drawing tool during drawing and accordingly reducing that a finger is moved by being pushed by the drawing tool during drawing.

According to an embodiment of the present invention, there is provided a drawing unit which holds a drawing tool for drawing on a drawing target surface in contact with the drawing target surface and moves the drawing tool; and a control unit which controls the drawing unit, wherein the drawing target surface has a curved shape along a first direction, the drawing unit sets the drawing tool either a first state in which the drawing tool is in contact with the drawing target surface and a second state in which the drawing tool is separated from the drawing target surface, the control unit controls the drawing unit so that the drawing tool moves along a second direction crossing with the first direction on a first region and a second region of the drawing target surface in the first state as a first operation, therefore the drawing tool draws on the first region and the second region, the first region and the second region are separated each other along the first direction, and controls the drawing unit so that the drawing tool moves between the first region and the second region in the second state as a second operation.

According to another embodiment of the present invention, there is provided a drawing method for a drawing device, the drawing device including a drawing unit which holds a drawing tool for drawing on a drawing target surface in contact with the drawing target surface and moves the drawing tool, the drawing target surface has a curved shape along a first direction, the drawing unit sets the drawing tool either a first state in which the drawing tool is in contact with the drawing target surface and a second state in which the drawing tool is separated from the drawing target surface, the drawing method comprising: a first operation step in which the drawing tool moves along a second direction crossing with the first direction on a first region and a second region of the drawing target surface in the first state by the drawing unit, therefore the drawing tool draws on the first region and the second region, and the first region and the second region are separated each other along the first direction; and a second operation step in which the drawing tool moves between the first region and the second region in the second state by the drawing unit.

DETAILED DESCRIPTION OF THE INVENTION

Figures 1A, 1B:
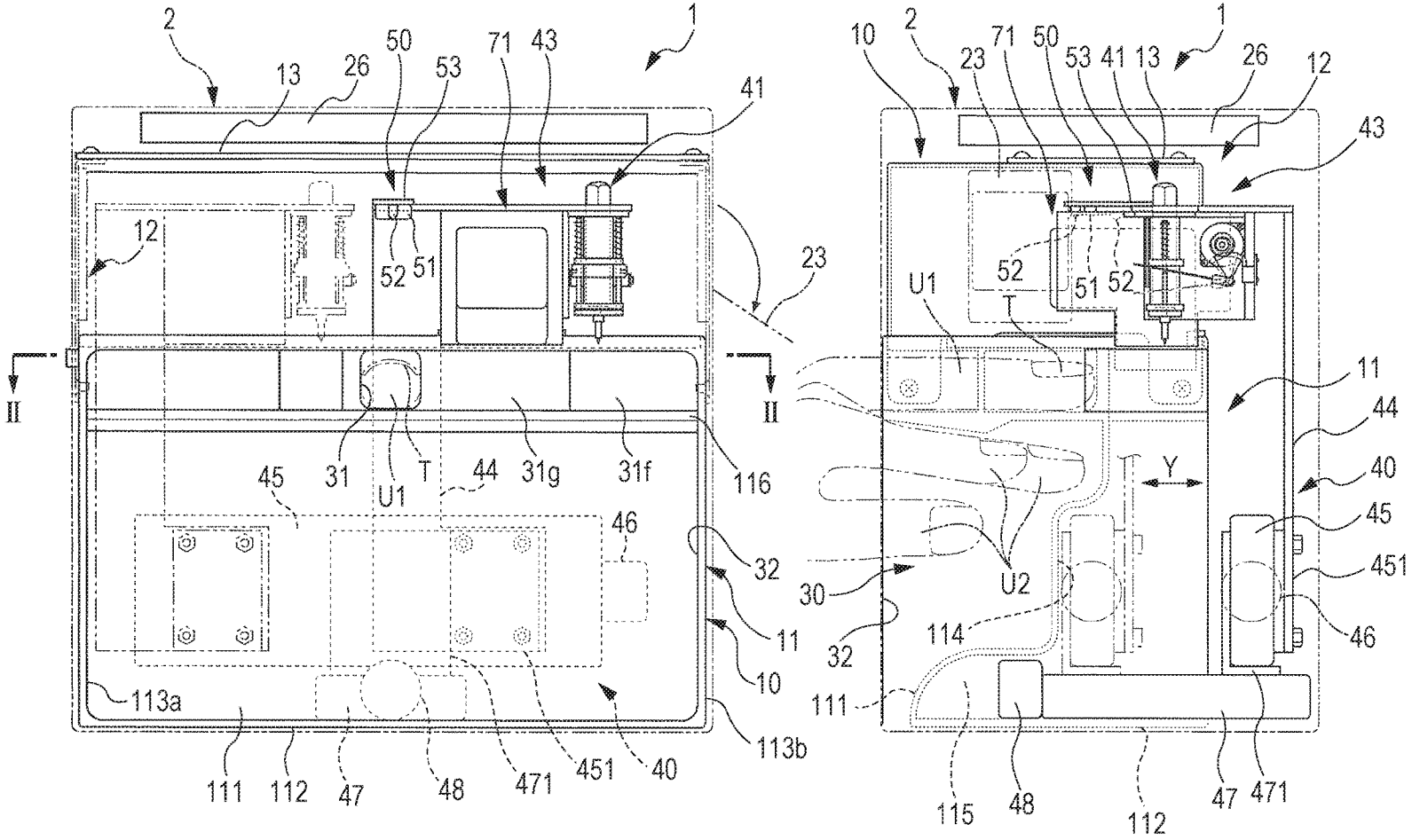
FIG. 1A is an elevation view of a drawing device according to embodiments described herein.
FIG. 1B is a side view of an internal configuration of the drawing device illustrated in FIG. 1A.

Embodiments of a nail printer (drawing device) and a drawing method for the nail printer (drawing device) according to the present invention will be described in detail below with reference to the drawings.

In each embodiment to be described below, technically preferable various limitations are applied to implement the present invention. However a scope of the present invention is not limited to each embodiment to be described below and illustrated examples.

In each embodiment to be described below, it is described that a nail printer performs drawing on a surface of a finger nail as a drawing target surface. However, the drawing target surface in the present invention is not limited to the surface of a finger nail, and, for example, the drawing target surface may be a surface of a toe nail.

First Embodiment

FIG. 1A is an elevation view of a nail printer and indicates an internal configuration of the nail printer.

FIG. 1B is a side view indicating an internal configuration of the nail printer illustrated in FIG. 1A.

Figure 2:
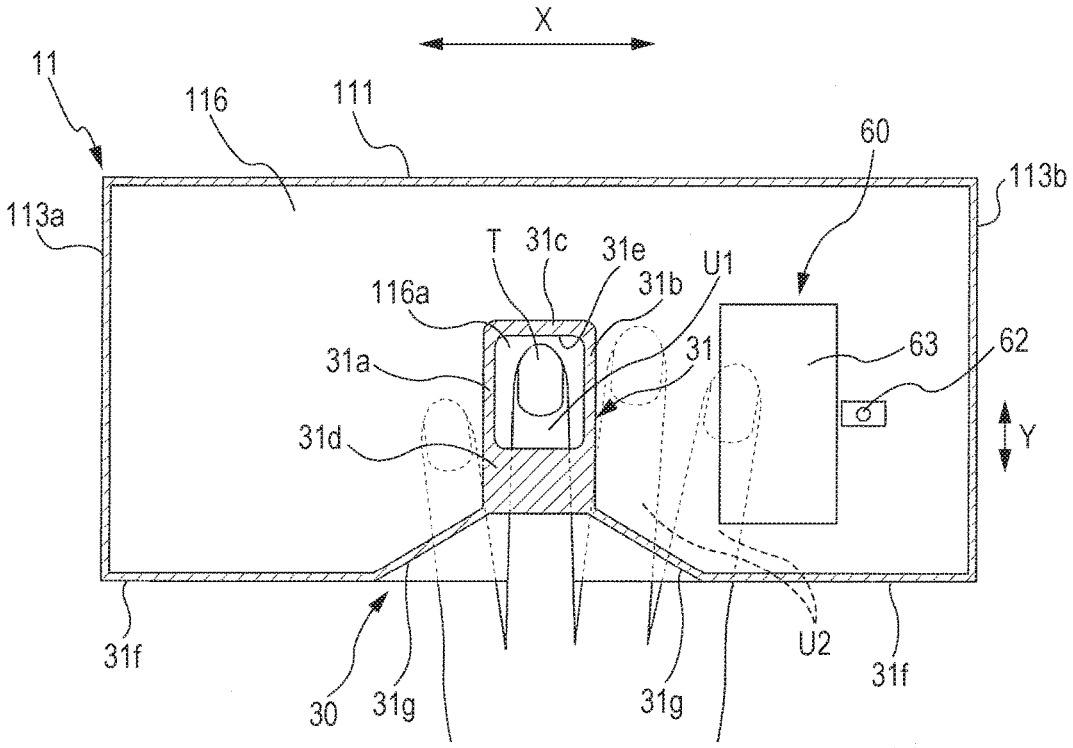
FIG. 2 is a II-II sectional view in FIG. 1.

FIG. 2 is a sectional view along line II-II in FIG. 1A.

As illustrated in FIGS. 1A and 1B, a nail printer 1 according to a first embodiment is a drawing device in which a drawing head 43 includes a pen 41 which is a drawing tool and an ink jet drawing unit 71, and drawing is performed on a nail T of a print finger U1 by using both of a plotter method and an ink jet method.

This nail printer 1 includes a case body 2 and a device body 10 stored in the case body 2.

A lid 23 which can be opened and closed to exchange the pen 41 and the ink jet drawing unit 71 of a drawing unit 40 to be described later is provided to one end of an upper side surface of the case body 2.

The lid 23 is rotatable from a close state to an open state as illustrated in FIG. 1A, for example, via a hinge.

An operation unit 25 (refer to FIG. 4) is displaced on an upper surface (top plate) of the case body 2.

The operation unit 25 is an input unit, and a user performs various input by using the input unit.

The operation unit 25 includes operation buttons (not illustrated) for performing various input, including a power switch button for turning on the nail printer 1, a stop switch button for stopping an operation, a design selection button for selecting a design image to be drawn on the nail T, and a drawing start button for starting drawing.

A display unit 26 is provided at an almost center portion on an upper surface (top plate) of the case body 2.

The display unit 26 includes, for example, a liquid crystal display (LCD), an organic electroluminescence display, and other flat display.

In the embodiment, this display unit 26 appropriately displays, for example, a nail image obtained by imaging the print finger U1 (a finger image including an image of the nail T), an image of such as an outline of the nail T included in the nail image, a design selection screen for selecting a design image to be drawn on the nail T, a thumbnail image for design confirmation, and an instruction screen for displaying various instructions.

A touch panel for performing various input may be integrally formed on a front face of the display unit 26.

The device body 10 is formed substantially in a box shape and includes a lower machine frame 11 and an upper machine frame 12. The lower machine frame 11 is disposed on an inner lower side of the case body 2. The upper machine frame 12 is disposed on an upper side of the lower machine frame 11 and on an inner upper side of the case body 2.

First, the lower machine frame 11 will be displayed.

The lower machine frame 11 includes a back plate 111, a bottom plate 112, a pair of right/left side plates 113*a* and 113*b*, an X direction moving stage storage unit 114, a Y direction moving stage storage unit 115, and a partition wall 116.

Lower ends of the side plates 113*a* and 113*b* are connected to each of right and left ends of the bottom plate 112, and the side plates 113*a* and 113*b* are erected on the bottom plate 112.

A lower portion of the back plate 111 is formed so as to be recessed in two steps toward a front side (front side in a finger insertion direction).

A lower end of the back plate 111 is connected to a front end of the bottom plate 112, and the back plate 111 partitions a region surrounded by the bottom plate 112 and the side plates 113*a* and 113*b* into front and rear sides.

A space formed on a back side of the recessed back plate 111 becomes the X direction moving stage storage unit 114 and the Y direction moving stage storage unit 115 (refer to FIG. 1B).

When the drawing unit 40 moves forward (a front side in a finger insertion direction), an X direction moving stage 45 of the drawing unit 40 is stored in the X direction moving stage storage unit 114.

A Y direction moving stage 47 of the drawing unit 40 is displayed in the Y direction moving stage storage unit 115.

The partition wall 116 is provided on an inner side of the lower machine frame 11 so as to partition a space on an inner front side of the lower machine frame 11 into an upper and lower sides (a space in a front side of a finger insertion direction surrounded by the back plate 111, the bottom plate 112, the side plates 113*a* and 113*b*.)

The partition wall 116 is provided substantially horizontally, right/left ends of the partition wall 116 are respectively connected to the side plates 113*a* and 113*b*, and a rear end of the partition wall 116 is connected to the back plate 111.

A finger fixing unit 30 (refer to FIG. 1B) is integrally provided to the lower machine frame 11.

The finger fixing unit 30 includes a finger reception unit 31 and a finger evacuation unit 32. The finger reception unit 31 receives a finger corresponding to the nail T to be drawn (hereinafter called "a print finger U1"). Fingers other than the print finger U1 (hereinafter called "non-print fingers U2") are evacuated in the finger evacuation unit 32.

The finger reception unit 31 is disposed on an upper side of the partition wall 116 and at a substantially center in a width direction of the lower machine frame 11.

A space partitioned into a lower side of the lower machine frame 11 by the partition wall 116 forms the finger evacuation unit 32.

For example, in the case where drawing is performed on the nail T of a third finger, the third finger is inserted into the finger reception unit 31 as the print finger U1, and other four fingers which are the non-print fingers U2 (the thumb, the forefinger, the middle finger, and the little finger) are inserted into the finger evacuation unit 32.

As illustrated in FIGS. 1B and 2, the finger reception unit 31 is opened on a front surface side of the lower machine frame 11 (a front side in a print finger insertion direction). A lower side, both sides, and a deep side are respectively partitioned by a finger placement unit 116*a* including a part of the partition wall 116, partitions 31*a* and 31*b*, and a partition 31*c*.

The finger placement unit 116*a* is a unit in which the nail T to be drawn (print finger U1) is placed on an XY plane.

An upper side of the finger reception unit 31 is partitioned by a ceiling 31*d*.

A window 31*e* for exposing the nail T of the print finger U1 inserted into the finger reception unit 31 is formed on the ceiling 31*d*.

A front wall 31*f* (refer to FIG. 1A) which closes a front surface side of the lower machine frame 11 is erected on both sides on a front surface side of the lower machine frame 11 which is on an upper surface of the partition wall 116.

A pair of guide walls 31*g* (refer to FIG. 1A) is erected on the upper surface of the partition wall 116. The guide walls 31*g* are narrowed from an end on a center side of the front wall 31*f* toward the finger reception unit 31 and guide the print finger U1 in the finger reception unit 31.

A user can sandwich the partition wall 116 between the print finger U1 inserted into the finger reception unit 31 and the non-print fingers U2 inserted into the finger evacuation unit 32. Therefore, the print finger U1 inserted into the finger reception unit 31 is stably fixed.

On an upper surface of the lower machine frame 11 which is on a side of the finger reception unit 31 (a right side in FIGS. 1A and 2 according to the embodiment), a home area 60, in which the drawing head 43 to be described later waits while drawing is not performed, is provided in a movable range of the drawing head 43.

A pen cap 62 is disposed in the home area 60. The quantity of the pen cap 62 corresponds to the quantity of a pen holder 42 to be described later (one in the embodiment).

The pen cap 62 is formed of such as rubber. When drawing is not performed in a state in which the pen 41 is attached to the drawing unit 40 (during non drawing), the pen 41 is moved down, and a pen tip 413 is stored in the pen cap 62 to prevent dry of the pen tip 413.

An ink jet maintenance unit 63 is provided in the home area 60 and at a position corresponding to a position in which the ink jet drawing unit 71 is disposed when the pen tip 413 is stored in the pen cap 62.

The ink jet maintenance unit 63 includes such as a cleaning mechanism (not illustrated) for cleaning an ink ejection unit (a nozzle surface) of the ink jet drawing unit 71 to be described later and a cap mechanism (not illustrated) for keeping a moisturized state of the ink ejection unit (a nozzle surface).

An arrangement of the pen cap 62 and the ink jet maintenance unit 63 in the home area is not limited to the example described herein.

The drawing unit 40 includes such as the drawing head 43, a unit supporting member 44 supporting the drawing head 43, an X direction moving stage 45 to move the drawing head 43 in an X direction (X direction in FIGS. 1A and 2 and right and left directions of the drawing device 1), an X direction moving motor 46, a Y direction moving stage 47 to move the drawing head 43 in a Y direction (Y direction in FIGS. 1B and 2 and front and rear directions of the drawing device 1), and a Y direction moving motor 48.

Figure 3A:
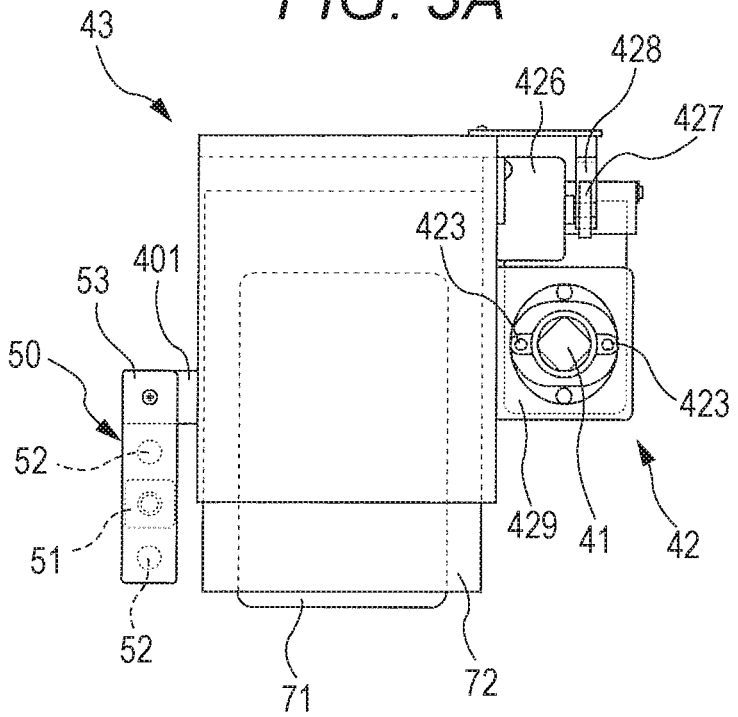
FIG. 3A is a top view of a drawing head according to the embodiments.
Figure 3B:
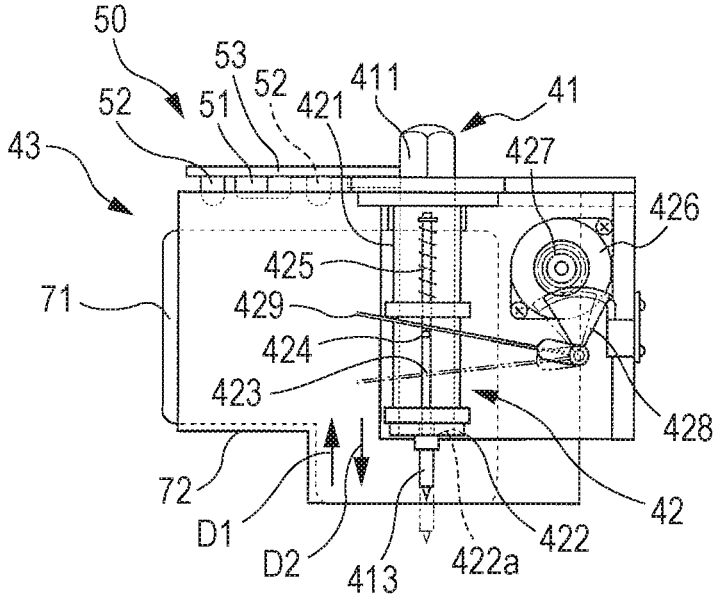
FIG. 3B is a side view of the drawing head according to the embodiments.

FIG. 3A is a top view of the drawing head 43 according to the embodiment. FIG. 3B is a side view of the drawing head 43.

As illustrated in FIGS. 3A and 3B, the pen holder 42 for holding the pen 41 and an ink jet holder 72 for holding the ink jet drawing unit 71 are arranged adjacent each other to the drawing head 43 according to the embodiment.

The ink jet drawing unit 71 is an ink cartridge-integrated head in which ink cartridges (not illustrated) and an ink ejection unit (not illustrated) are integrally formed. The ink cartridges correspond to inks of, for example, yellow (Y: YELLOW), magenta (M: MAGENTA), and cyan (C: CYAN). The ink ejection unit is provided on a surface (a lower surface in such as FIG. 1A in the embodiment) opposing to a drawing target (the nail T) in each ink cartridge.

The ink ejection unit includes a nozzle array having multiple nozzles to jet ink of each color. The ink jet drawing unit 71 performs drawing by forming ink into fine droplets and directly spraying the ink on a surface to be drawn of a drawing target (the nail T) from the ink ejection unit.

The ink jet drawing unit 71 is not limited to a unit for ejecting ink of the above three colors. An ink cartridge for storing other inks and an ink ejection unit may be further included.

One pen 41 can be attached to the pen holder 42 according to the embodiment.

The pen 41 is a writing tool and performs drawing by which a tip comes into contact with a surface of the nail T which is a drawing target surface.

As illustrated in such as FIG. 3B, in the pen 41, a pen tip 413 is provided on a tip side of a stick-shaped pen shaft 411 (a lower side in FIG. 3B). The inside of the pen shaft 411 is an ink storage unit for storing each type of ink.

As ink stored in the pen shaft 411, each type of ink can be applied. Viscosity of ink and a particle diameter (particle size) of a color material are not limited. For example, a gold and silver lame-containing ink, a write ink, a UV-curable ink, a gel nail, an ink for undercoating, an ink for topcoating, and a manicure liquid can be used.

In the embodiment, the pen 41, for example, draws in a way in which the ink stored in the pen shaft 411 oozes out when the pen tip 413 is pressed on a surface of the nail T and has a ball-point pen-type pen tip 413.

The pen 41 is not limited to the ball-point pen-type. For example, the pen 41 may be a felt-tip pen-type pen which draws in a way in which a felt-like pen tip is soaked with ink and a brush pen-type pen which draws in a way in which a brush is soaked with ink. The pen tips 413 having various widths can be prepared.

The pens 41 held by the pen holder 42 may be pens having same-type pen tips 413 or having different-type pen tips 413.

The pen 41 is held by inserting into the pen holder 42 from upward. Therefore, the pen 41 can be easily exchanged by opening the lid 23 provided to the case body 2 and picking and drawing an upper end of the pen shaft 411 by hand or by tweezers.

Accordingly, a user can realizes a wide range of nail designs by appropriately exchanging the pen 41 attached to the pen holder 42 to the pen 41 of a different color, the pen 41 having a different-type pen tip 413, or the pen 41 using a different-type ink, depending on a nail design to be drawn.

In the embodiment, when the pen 41 is attached to the pen holder 42, a user inputs from such as the operation unit 25 what type of the pen 41 is attached to the pen holder 42 and registers the information.

Specifically, for example, an identification number to identify a shape and a width of the pen tip 413 of the pen 41 and the type of stored ink is applied to each of the pens 41, and a user inputs the identification number from such as the operation unit 25.

By applying such as a bar code indicating the identification number to the pen 41 and providing such as a bar code reader to read the bar code on the pen holder 42 side, when the pen 41 is set to the pen holder 42, the identification number may be automatically read and information of the pen 41 may be registered.

The registered information on the pen 41 is stored in a pen information storage region 824 in the storage unit 82.

The pen holder 42 includes a cylindrical member 421, a pen locking member 422, and an auxiliary shaft member 423. The cylindrical member 421 vertically opens, and the pen 41 is inserted into the cylindrical member 421. The pen locking member 422 is disposed so as to close an opening on a lower side of the cylindrical member 421 (a lower side in FIG. 3B). The auxiliary shaft member 423 vertically moves with the pen 41.

A locking hole 422*a* to lock a tip side of the pen shaft 411 of the pen 41 is formed to the pen locking member 422.

The pen 41 is locked in the pen holder 42 by which the tip side of the pen shaft 411 is fitted into the locking hole 422*a* of the pen locking member 422.

A screw groove (not illustrated) is formed on an outer peripheral surface on a tip side of the pen shaft 411, a screw groove (not illustrated) which can be screwed with the screw groove of the shaft is provided on an inner peripheral surface of the locking hole 422*a*, and the pen 41 may be locked by the locking hole 422*a* by which the screw groove on the shaft 411 side is screwed with the screw groove on the locking hole 422*a* side.

According to the embodiment, two auxiliary shaft members 423 are disposed so as to sandwich the pen 41. A lower end of each auxiliary shaft member 423 is fitted into the pen locking member 422. Accordingly, the auxiliary shaft member 423 is fixed in parallel with the pen shaft 411 of the pen 41.

The locking projection 424 projecting in a direction away from a shaft center of the pen 41 is provided to the auxiliary shaft member 423.

A coil spring 425 is wound around a shaft of the auxiliary shaft member 423.

The coil spring 425 energizes the auxiliary shaft member 423 in an upper direction D1 in a state in which an external force is not applied, and while drawing is not performed, the pen 41 is held at a position where the pen tip 413 does not come into contact with the nail T.

A motor 426 for vertically moving a pen, a gear 428, and a plate spring 429 are provided near the pen holder 42. The motor 426 for vertically moving a pen includes a stepping motor. The gear 428 meshes with a gear wheel 427 attached to a rotation shaft of the motor 426 for vertically moving a pen. The plate spring 429 rotates following rotation of the gear 428.

In the embodiment, such as the motor 426 for vertically moving a pen, the gear wheel 427, the gear 428, and the plate spring 429 form a lifting mechanism of the pen 41.

Herein, the plate spring 429 is engaged with the locking projection 424 provided to the auxiliary shaft member 423, and the pen 41 can be pushed down in a lower direction D2 by pushing down the locking projection 424.

Specifically, the plate spring 429 rotates with rotation of the motor 426 for vertically moving a pen, and the plate spring 429 is engaged with the locking projection 424. When the locking projection 424 is pushed down, the pen 41 is pushed down in the lower direction D2 against an energizing force of the coil spring 425.

As described above, in the embodiment, the pen 41 is not directly pushed down by the plate spring 429, and the locking projection 424 is pushed down. Since the plate spring 429 does not cover an upper side of the pen 41, the pen 41 can be easily exchanged. Further, the height of a lifting mechanism of the pen 41 can be relatively reduced, and therefore a space can be saved.

Herein, operation of a lifting mechanism of the pen 41 will be specifically described.

First, while drawing is not performed, the plate spring 429 does not apply an external force to the locking projection 424.

In a state in which an external force (a pushing force by the plate spring 429) is not applied as described above, the pen 41 is pushed up by an energizing force of the coil spring 425 in the upper direction D1 (an upper direction in FIGS. 1A and 3B), and the pen tip 413 which is a tip of the pen 41 is separated from a surface of the nail T which is a drawing target surface and held at a height in which the pen tip 413 does not come into contact with the surface.

On the other hand, during drawing, the motor 426 for vertically moving a pen is rotated by the predetermined number of steps and pushes down the locking projection 424 by the plate spring 429. Accordingly, the pen 41 is pushed down in the lower direction D2.

In the case where the motor 426 for vertically moving a pen is driven, the predetermined number of steps is appropriately set in accordance with such as the height H of the nail T of the print finger U1 inserted into the finger reception unit 31.

Specifically, in the nail printer 1 according to the embodiment, nail information to be described later is obtained in advance. Then, based on the nail information, the height H of the nail T coming into contact with the pen tip 413 which is a tip of the pen 41 is recognized, and the number of steps of the motor 426 for vertically moving a pen is determined according to the height H. The motor 426 for vertically moving a pen is driven by the number of steps determined in this manner, and the pen 41 is pushed down by the plate spring 429. Accordingly, the pen tip 413 of the pen 41 is approached and contacted to a surface of the nail T and applies a proper pen pressure on the nail T.

When the height H in which drawing is performed on the nail T is changed with a change in a position to be drawn while drawing, a pen pressure of the pen 41 is adjusted each time by increasing and decreasing the number of steps of the motor 426 for vertically moving a pen, and drawing is performed while adjusting the pen pressure so as to be substantially stable.

Adjustment of the pen pressure by increasing and decreasing the number of steps of the motor 426 for vertically moving a pen is performed every time when the height H of the nail T is changed by a predetermine amount (for example 0.5 mm), and the pen pressure is not adjusted when the height H of the nail T is changed less than the predetermined amount. However, at this time, the plate spring 429 is bent and deformed (elastic deformation) according to a shape of the nail T, and accordingly the pen 41 automatically moves up and down. Therefore, the pen 41 can certainly come into contact with the nail T, and a pen pressure can be reasonably secured.

A spring constant of the plate spring 429 is not so large, and this spring constant is set to a value such that the nail T does not feel pain when a pushing force (external force) by the plate spring 429 is applied to the nail T.

While drawing, by moderately bending the plate spring 429, a shock by vertical movement of the pen 41 is absorbed. Further, the pen 41 vertically moves following a change in the height H of the nail T while keeping a state in which a substantially stable moderate pen pressure is applied to the pen tip 413, and a desired nail design can be finely drawn on a surface of the nail T which is a drawing target.

A unit supporting member 44 is fixed to an X direction moving unit 451 attached to the X direction moving stage 45. The X direction moving unit 451 moves in an X direction along a guide (not illustrated) on the X direction moving stage 45 by driving the X direction moving motor 46. Thus, the drawing head 43 attached to the unit supporting member 44 moves in the X direction (an X direction in FIG. 1A, and right and left directions of the nail printer 1).

The X direction moving stage 45 is fixed to a Y direction moving unit 471 on a Y direction moving stage 47. The Y direction moving unit 471 moves in a Y direction along a guide (not illustrated) on the Y direction moving stage 47 by driving the Y direction moving motor 48. Thus, the drawing head 43 attached to the unit supporting member 44 moves in the Y direction (the Y direction in FIG. 1B, and front and rear directions of the nail printer 1).

In the embodiment, the X direction moving stage 45 and the Y direction moving stage 47 are formed by combining the X direction moving motor 46 and the Y direction moving motor 48 with a ball screw (not illustrated) and a guide (not illustrated).

In the embodiment, a head moving unit 49 is formed by the X direction moving motor 46 and the Y direction moving motor 48 as an XY driving unit which drives the drawing head 43 including the pen 41 in an X direction and a Y direction.

The motor 426 for vertically moving a pen, the ink jet drawing unit 71, the X direction moving motor 46, and the Y direction moving motor 48 in the drawing unit 40 are connected to a drawing control unit 815 (refer to FIG. 4) in a control device 80 to be described later and controlled by the drawing control unit 815.

An imaging unit 50 includes an imaging device 51 and a lighting device 52.

The imaging unit 50 illuminates the nail T of the print finger U1 which is inserted in the finger reception unit 31 and can be seen from the window 31*e* by the lighting device 52. The imaging device 51 images the print finger U1, and a nail image which is an image of the nail T of the print finger U1 (a finger image including a nail image) is obtained.

In the embodiment, the imaging device 51 and the lighting device 52 are fixed on a side (a left side of the drawing head 43 in FIG. 1A) of the drawing head 43 of the drawing unit 40.

Specifically, as illustrated in FIG. 3A, the drawing head 43 of the drawing unit 40 includes an overhanding portion 401 which overhangs on one end side (left side in FIG. 3A) of an upper surface, and a substrate 53 is attached to this overhanding portion 401.

The imaging device 51 and the lighting device 52 included in the imaging unit 50 are provided so as to oppose to the partition wall 116 on a lower surface of the substrate 53.

A size of the substrate 53 and positions of the imaging device 51 and the lighting device 52 attached to the substrate 53 are not limited.

The imaging device 51 is a compact camera including, for example, a solid state imaging device having more than two million pixels and a lens.

To detect such as a curvature of the nail T of the print finger U1, the imaging device 51 images the nail T from at least two different positions and angles by movement of the head moving unit 49. Accordingly, at least two nail images are obtained, and based on these nail images, a nail information detection unit 812 to be described later detects nail information on such as an outline of the nail T (a shape of the nail T) a curved shape of the nail T (a curvature of the nail T), and a vertical position of the nail T.

In the embodiment, the imaging device 51 can image in which the imaging device 51 is moved by the head moving unit 49 to an upper side of the nail T of the print finger U1 inserted into the finger reception unit 31. Therefore, an imaging possible range of the imaging device 51 covers at least one nail T.

The lighting device 52 is a lighting lamp of such as while LED.

In the embodiment, two lighting devices 52 are arranged so as to sandwich the imaging device 51 on a front side and a deep side of the imaging device 51. The lighting devices 52 illuminates an imaging range on a lower side of the imaging device 51 by emitting a light downward.

The number and arrangement of the provided lighting devices 52 are not limited to the illustrated example.

The imaging unit 50 is connected to an imaging control unit 811 (refer to FIG. 4) in the control device 80 to be described later and controlled by the imaging control unit 811.

Image data of an image imaged by the imaging unit 50 is stored in a nail image storage region 821 in the storage unit 82 to be described later.

The control device 80 is, for example, arranged on such as the substrate 13 disposed on the upper machine frame 12.

Figure 4:
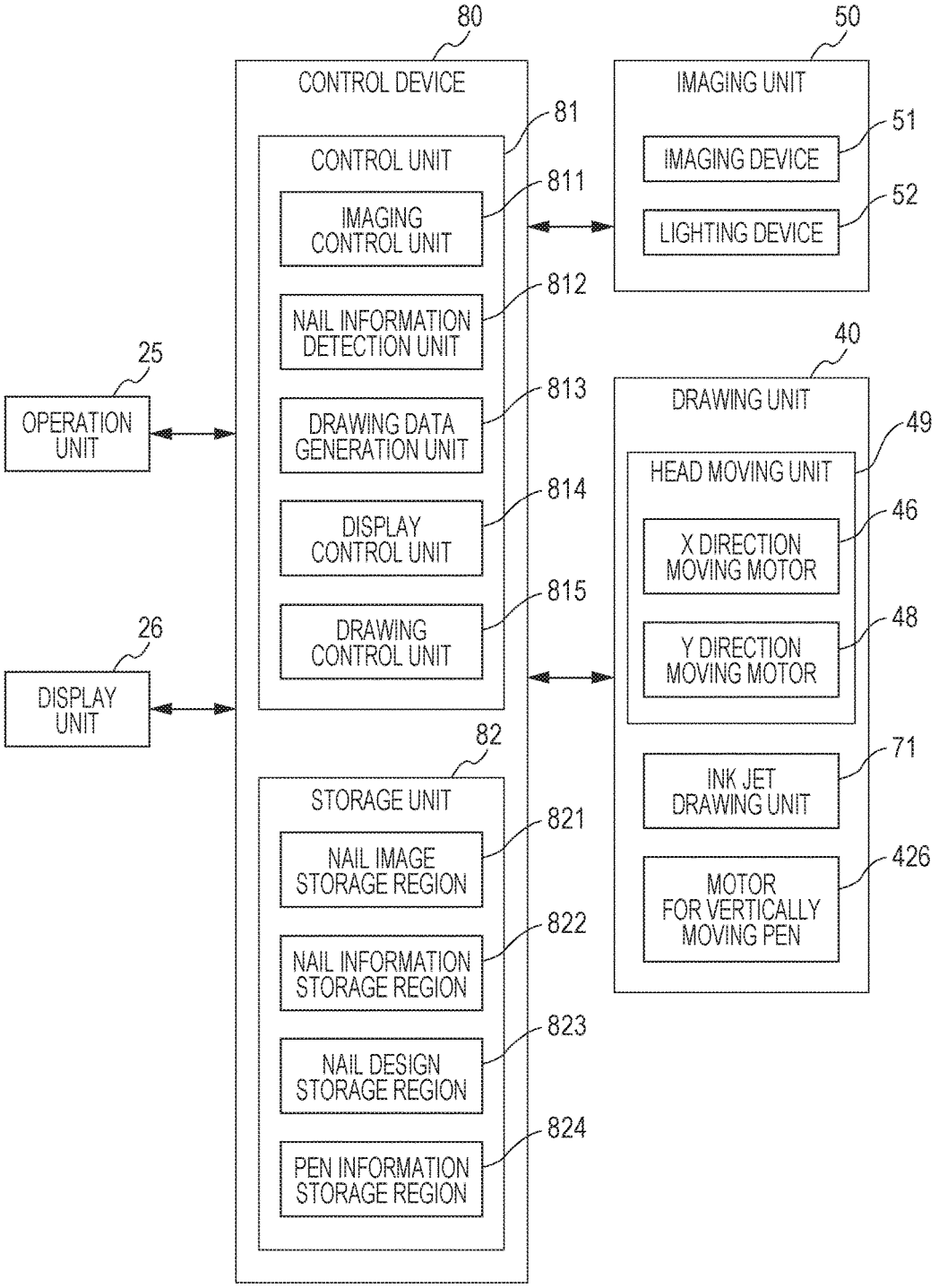
FIG. 4 is a block diagram of a main portion indicating a control configuration of the drawing device according to the embodiments.

FIG. 4 is a block diagram of a main portion indicating a control configuration according to the embodiments.

The control device 80 is a computer including the control unit 81 and the storage unit 82 as illustrated in FIG. 4. The control unit 81 includes a central processing unit (CPU) (not illustrated). The storage unit 82 includes read only memory (ROM) (not illustrated) and random access memory (RAM) (not illustrated).

The storage unit 82 stores various-type programs and data to operate the nail printer 1.

Specifically, the ROM in the storage unit 82 stores various programs including a nail information detection program, a drawing data generation program, and a drawing program. The nail information detection program is a program for detecting nail information on such as a shape and an outline of the nail T from a nail image. The drawing data generation program is a program for generating drawing data. The drawing program is a program for performing a drawing process. Each unit in the nail printer 1 is totally controlled by which these programs are executed by the control device 80.

In the embodiment, the storage unit 82 includes the nail image storage region 821, a nail information storage region 822, a nail design storage region 823, and a pen information storage region 824. The nail image storage region 821 stores a nail image of the nail T of the print finger U1 of a user, which is obtained by the imaging unit 50. The nail information storage region 822 stores nail information (an outline and an inclination angle of the nail T) detected by the nail information detection unit 812. The nail design storage region 823 stores image data of a nail design to be drawn on the nail T. The pen information storage region 824 stores information on the pen 41.

In a functional view, the control unit 81 includes an imaging control unit 811, the nail information detection unit 812, the drawing data generation unit 813, a display control unit 814, and the drawing control unit 815.

Functions as the imaging control unit 811, the nail information detection unit 812, the drawing data generation unit 813, the display control unit 814, and the drawing control unit 815 are realized by which programs stored in a CPU in the control unit 81 and ROM in the storage unit 82 are executed together.

The imaging control unit 811 controls the imaging device 51 and the lighting device 52 of the imaging unit 50 and causes the imaging device 51 to image a finger image including an image of the nail T of the print finger U1 inserted into the finger reception unit 31 (hereinafter called "a nail image").

In the embodiment, the imaging device 51 is moved by the drawing control unit 815 which controls the head moving unit 49, and the imaging control unit 811 causes the imaging device 51 to obtain at least two nail images from two different positions and angles (for example, from immediately above the nail T and from diagonally upward of the nail T).

An image data of a nail image obtained by the imaging unit 50 is stored in the nail image storage region 821 in the storage unit 82.

The nail information detection unit 812 is for detecting nail information on the nail T of the print finger U1 based on an image of the nail T of the print finger U1 inserted into the finger reception unit 31, which is imaged by the imaging device 51.

Herein, nail information means, for example, an outline of the nail T (such as a nail shape, an XY coordinate at a horizontal position of the nail T), the height H of the nail T (position in a vertical direction of the nail T, hereinafter called "a vertical position of the nail T" or simply "a position of the nail T"), and an inclination angle with respect to an XY plane on a surface of the nail T (an inclination angle of the nail T, and a nail curvature).

The length of a width direction W (a horizontal direction, a first direction) and an extending direction L (a longitudinal direction, a second direction) of the nail T are obtained from an XY coordinate at a horizontal position of the nail T.

The nail information detection unit 812 can accurately detect a curvature of the nail T by detecting nail information by using a plurality of nail images imaged from different positions and angles (for example, from immediately above the nail T and from diagonally upward of the nail T).

The drawing data generation unit 813 generates data for drawing performed on the nail T of the print finger U1 by the drawing head 43 based on a nail information detected by the nail information detection unit 812.

Figure 5A:
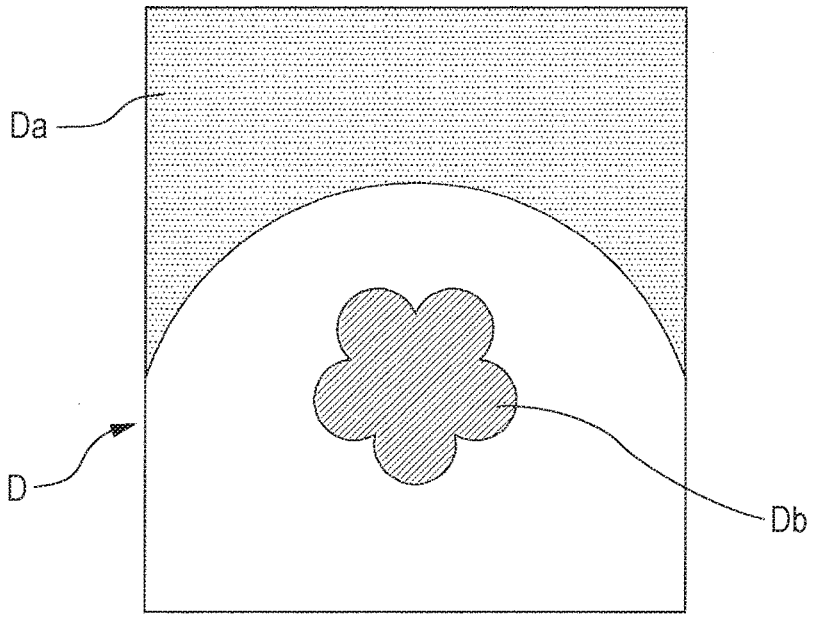
FIG. 5A is a view illustrating an image of nail design image data.

FIG. 5A is an image view of nail design image data D.

Figure 5B:
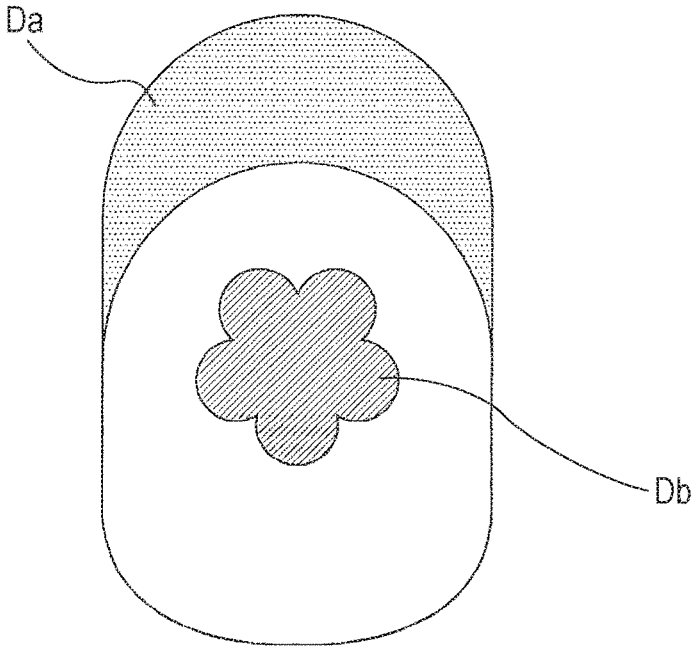
FIG. 5B is an image view illustrating a state in which the nail design illustrated in FIG. 5A is fit to a nail.

FIG. 5B is an image view illustrating a state in which the nail design illustrated in FIG. 5A is fitted into the nail T.

For example, in the case where, as illustrated in FIG. 5A, the nail design image data D includes a painted-out drawing region Da at a portion corresponding to a tip side of the nail T and a flower-shaped painted-out drawing region Db at a portion corresponding to a substantially center of the nail T, the drawing data generation unit 813 performs a fitting process by expanding, reducing, and cutting out the nail design image data D based on a shape of the nail T detected by the nail information detection unit 812, and generates drawing data for performing drawing on the nail T as illustrated in FIG. 5B.

The drawing data generation unit 813 fits the nail design image data into a shape of the nail T according to the nail information detected by the nail information detection unit 812, and a curved surface is suitably corrected.

Accordingly, the nail design drawing data drawn by the pen 41 and the ink jet drawing unit 71 is generated.

The display control unit 814 controls the display unit 26 and causes the display unit 26 to display various display images.

In the embodiment, the display control unit 814 causes the display unit 26 to display, for example, a nail design selection screen, a thumbnail image for design confirmation, a nail image obtained by imaging the print finger U1, each instruction screen, and an operation screen.

The drawing control unit 815 is a control unit which outputs a control signal to the drawing unit 40 based on drawing data generated by the drawing data generation unit 813 and controls such as the X direction moving motor 46, the Y direction moving motor 48, the motor 426 for vertically moving a pen, and the ink jet drawing unit 71 of the drawing unit 40 so as to perform drawing to the nail T according to the drawing data.

Specifically, the drawing control unit 815 controls the motor 426 for vertically moving a pen while the pen 41 is not drawing and keeps a state in which the locking projection 424 is not pushed down by the plate spring 429.

During drawing, the drawing control unit 815 operates the motor 426 for vertically moving a pen and controls operation of the motor 426 for vertically moving a pen such that the locking projection 424 is pushed down by the plate spring 429, and a tip end of the pen 41 (the pen tip 413) comes into contact with a surface of the nail T.

At a portion which cannot be fitted even if the plate spring 429 bends and deforms (elastic deformation) since the height H of the nail T significantly changes, the drawing control unit 815 preferably appropriately increases and decreases the number of steps of the motor 426 for vertically moving a pen, adjust a pen pressure of the pen 41 with respect to the nail T, and substantially stabilizes the pen pressure.

In the embodiment, when the pen 41 performs drawing, the drawing control unit 815 causes the pen 41 to draw each line along an extending direction of the nail T.

Figure 6A:
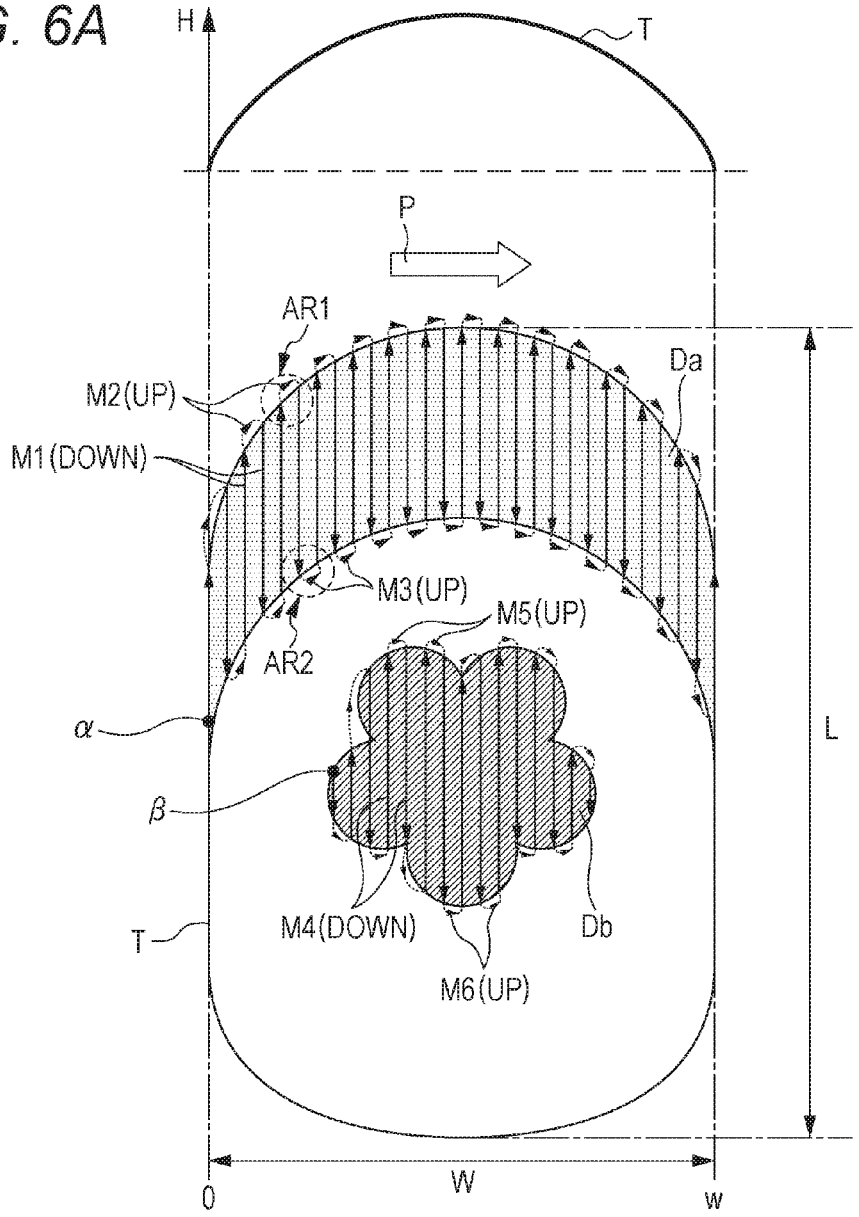
FIGS. 6A and 6B are views for describing a procedure for drawing processes according to a first embodiment.
Figure 6B:
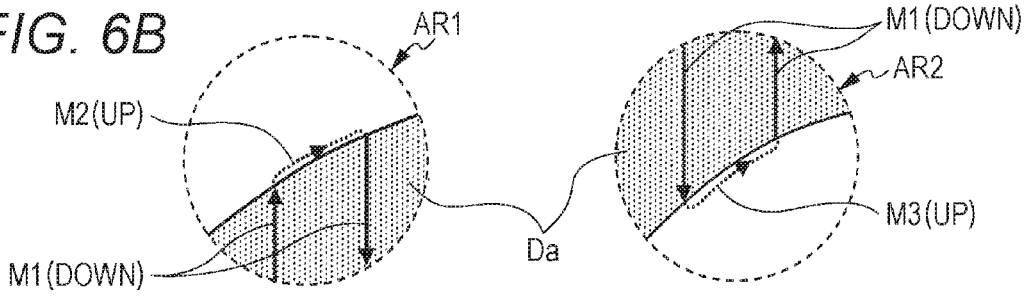

FIGS. 6A and 6B are views for describing a procedure for a drawing process by the pen 41 according to the embodiment.

In FIG. 6A, an upper view is a view illustrating a sectional shape of the nail T in the width direction W, and a lower view is a plan view viewing the nail T from upward.

FIG. 6B is an enlarged view of regions AR1 and AR2 in the lower view of FIG. 6A.

In FIGS. 6A, and 6B, M1, M2, M3, M4, M5, and M6 indicate moving routes of the pen tip 413 when drawing is performed on the nail T by the pen 41, UP indicates that the pen tip 413 moves in a state in which the pent tip 413 is separated from a surface of the nail T, and DOWN indicates that the pen tip 413 moves in a state in which the pen tip 413 is in contact with a surface of the nail T.

Specifically, in FIG. 6A, the moving routes M1 and M4 indicated by solid lines indicate moving routes of the pen tip 413 in a state in which the pen tip 413 is in contact with a surface of the nail T and indicate that the pen tip 413 moves in directions of arrows.

On the other hand, in FIG. 6A, the moving routes M2, M3, M5, and M6 indicated by dotted lines indicate moving routes of the pen tip 413 in a state in which the pen tip 413 is separated from a surface of the nail T and indicates that the pen tip 413 moves in directions of arrows.

Accordingly, drawing is sequentially performed on the nail T in directions of void arrows P.

As illustrated in FIGS. 6A and 6B, in the embodiment, the drawing control unit 815 causes the pen tip 413 of the pen 41 which is a drawing tool to come into contact with a drawing starting position $\alpha$ on one end side (left end side) of the width direction W of the nail T. From the position, the drawing control unit 815 draws one line by moving the pen tip 413 in directions of arrows (second direction) of the moving routes M1 and M4 along the extending direction L of the nail T in a state in which the pen tip 413 is in contact with the nail T (a first operation).

The pen tip 413 is moved in directions of arrows of the moving routes M1 and M4 along the extending direction L and moved to end points of the moving routes M1 and M4. Then, the pen 41 is moved up, and the pen tip 413 is separated from a surface of the nail T. In this state, the pen tip 413 of the pen 41 is moved along the width direction W of the nail T in directions of arrows of the moving routes M2, M3, M5, and M6 and moved to a starting position of the moving routes M1 and M4 of a next line (one line) (a second operation).

Then, the drawing control unit 815 draws one line by moving the pen tip 413 in directions of arrows (the second direction) of the moving routes M1 and M4 along the extending direction L from a drawing starting position of the next line in a state in which the pen tip 413 is in contact with the surface of the nail T (the first operation).

The pen tip 413 is moved in directions of arrows of the moving routes M1 and M4 along the extending direction L and moved to end points of the moving routes M1 and M4. Then, the pen 41 is moved up, and the pen tip 413 is separated from a surface of the nail T.

In this state, the pen tip 413 of the pen 41 is moved along the width direction W of the nail T in directions of arrows of the moving routes M2, M3, M5, and M6 and moved to a starting position of the moving routes M1 and M4 of a next line (one line) (a second operation).

The drawing control unit 815 controls the head moving unit 49 and a lifting mechanism such that operation control (specific operation control) including the first and second operations is performed while a drawing process is performed to the nail T.

Specifically, regarding the painted-out drawing region Da at a tip of the nail T in FIG. 6A, a left side (left side in FIG. 6) end in the width direction W of the nail T becomes an initial drawing starting position α.

The pen 41 is moved down at the drawing starting position α, and the pen tip 413 is made to contact with the nail T.

One line is drawn from this point by moving the pen 41 in a direction (the second direction) along the moving route M1 indicated by an upward arrow in FIGS. 6A and 6B along the extending direction L of the nail T (the first operation, moved upward in FIG. 6A).

After one line is drawn, the drawing control unit 815 causes the pen 41 to move up once by a lifting mechanism to the height in which the pen 41 does not come into contact with a surface of the nail T. Then, the drawing control unit 815 moves the pen 41 in a right direction (right direction in FIG. 6A) in the width direction W of the nail T along the moving route M2 (the second operation).

After the pen 41 is moved to a drawing starting position (a highest position of a next line in the embodiment) of a next line, the pen 41 is moved down and the pen tip 413 comes into contact with the nail T.

One line is drawn from this point by moving the pen 41 in a direction (the second direction) along the moving route M1 indicated by downward arrows in FIGS. 6A and 6B along the extending direction L of the nail T (the first operation, moved downward in FIG. 6A).

As described above, the drawing control unit 815 subsequently performs drawing from one end side to another end side in the width direction W of the nail T by moving up and down the pen 41 every time after one line is drawn in the extending direction L of the nail T.

Similarly, regarding the flower-shaped painted-out drawing region Db positioned at a substantially center of the nail T, an initial drawing starting position β is positioned on a left side (left side in FIG. 6A) in the width direction W of the nail T, and the drawing control unit 815 draws one line by moving the pen 41 in a direction (the second direction) along the moving route M4 indicated by a downward arrow in FIG. 6A (moved downward in FIG. 6A) along the extending direction L of the nail T from the drawing starting position β in a state in which the pen tip 413 is in contact with a surface of the nail T (the first operation).

After one line is drawn, the drawing control unit 815 once moves up the pen 41 to the height in which the pen 41 does not come into contact with a surface of the nail T by a lifting mechanism and moves the pen 41 to a starting position of the moving route M4 of a next line in a right direction (right direction in FIG. 6A) in the width direction W of the nail T along the moving route M6 (the second operation).

Then, the drawing control unit 81 draws one line by moving the pen tip 413 in a direction (the second direction) along the moving route M1 indicated by an upward arrow in FIG. 6A from a drawing starting position of the next line (the lowest position on the next line in the embodiment) in a state in which the pen 41 is in contact with the nail T (the first operation).

After one line is drawn, the drawing control unit 815 once moves up the pen 41 to the height in which the pen 41 does not come into contact with a surface of the nail T by a lifting mechanism and moves the pen 41 to a starting position of the moving route M1 of a next line in a right direction in the width direction W of the nail T along the moving route M5 (the second operation).

As described above, the drawing control unit 815 subsequently performs drawing to a right side (right side in FIG. 6) in the width direction W of the nail T by moving up and down the pen 41 every time after one line is drawn in the extending direction L of the nail T.

Next, a drawing method by the nail printer 1 according to the embodiment will be described with reference to FIGS. 6 and 7.

In the case where the nail printer 1 performs drawing, a user first turns on a power switch and starts the control device 80.

Figure 7:
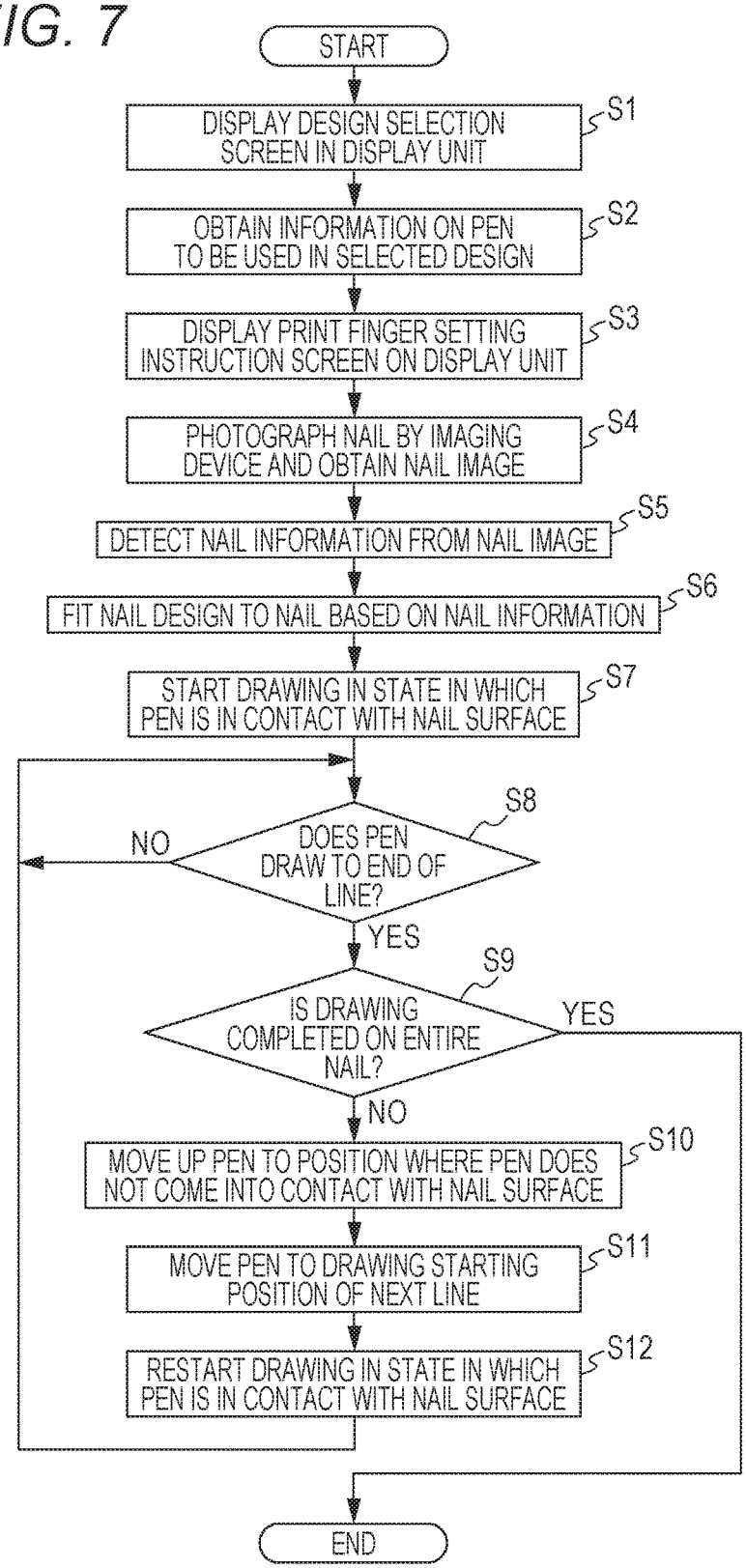
FIG. 7 is a flowchart indicating the drawing processes according to the first embodiment.

As illustrated in FIG. 7, the display control unit 814 causes the display unit 26 to display a design selection screen (step S1).

The user operates such as an operation button 251 of the operation unit 25 and selects a desired nail design from a plurality of nail designs displayed on the design selection screen. Accordingly, a selection instruction signal is output from the operation unit 25, and a nail design to be drawn on the nail T is selected.

When the nail design is selected, the display control unit 814 causes the display unit 26 to display an instruction screen to set the pen 41 necessary to draw the nail design to the predetermined pen holder 42 of the drawing head 43.

The user sets the predetermined type of the pen 41 to the predetermined pen holder 42 in accordance with an instruction displayed on the display screen. At this time, the user inputs, from the operation unit 25, information (a type and a shape of the pen) on the pen 41 set to the pen holder 42. The input information is output to the control unit 81.

When the control unit 81 obtains the information (a type and a shape of the pen) on the pen 41 (step S2), the control unit 81 causes the pen information storage region 824 to store the obtained information.

Next, the display control unit 814 causes the display unit 26 to display an instruction screen for causing the finger reception unit 31 to set the print finger U1 (step S3).

The user inserts the print finger U1 into the finger reception unit 31, inserts the non-print fingers U2 into the finger evacuation unit 32, and operates a drawing switch (not illustrated) in the operation unit 25 in a state in which the print finger U1 is fixed.

When an instruction is input from the drawing switch, before drawing operation is started, first, the imaging control unit 811 controls the imaging unit 50, and two imaging devices 51 images the print finger U1 in a state in which the print finger U1 is illuminated by the lighting device 52.

Accordingly, the imaging control unit 811 obtains at least two images (nail images) of the nail T of the print finger U1 inserted into the finger reception unit 31 (step S4).

Next, the nail information detection unit 812 detects nail information including an outline of the nail T (a nail shape) and an inclination angle of the nail T (a nail curvature) based on the nail image (step S5).

When the nail information including an outline of the nail T (a nail shape) and an inclination angle of the nail T (a nail curvature) is detected by the nail information detection unit 812, based on the nail information, the drawing data generation unit 813 fits nail design image data into the nail T (a fitting process) (step S6). Further, the drawing data generation unit 813 corrects a curved surface on the nail design image data based on the nail information. In this manner, drawing data is generated.

When the drawing data is generated, the drawing control unit 815 outputs drawing data to the drawing unit 40.

Then, the drawing control unit 815 operates the head moving unit 49 and moves the drawing head 43 on a surface of the nail T which is an upper side of a drawing starting position of a selected nail design.

In the case where the ink jet drawing unit 71 performs drawing, the drawing control unit 815 controls the ink jet drawing unit 71 so as to discharge ink according to the image data.

In the case where the pen 41 performs drawing, the drawing control unit 815 performs drawing by appropriately moving the pen 41 in an X direction, a Y direction, and a height direction.

A procedure especially in the case where the pen 41 performs drawing will be described below.

In the case where the pen 41 performs drawing, the motor 426 for vertically moving a pen in the pen holder 42, which holds the pen 41 on an upper side of a drawing starting position, is operated, and the pen 41 comes into contact with a surface of the nail T. Then, drawing starts from the drawing starting position (step S7).

For example, in the painted-out drawing region Da in a nail tip portion illustrated in FIG. 6A, the pen 41 is moved on an upper side of the drawing starting position α, and the pen 41 is moved down so as to come into contact with a surface of the nail T at the drawing starting position α. Then, one line is drawn by moving the pen 41 in a direction indicated by an arrow (the second direction) of the moving route M1 along the moving route M1 along the extending direction L of the nail T illustrated in FIG. 6A (moved upward in FIG. 6).

For example, in the flower-shaped painted-out drawing region Db at a center of the nail T illustrated in FIG. 6A, the pen 41 is moved on an upper side of the drawing starting position β, and the pen 41 is moved down so as to come into contact with a surface of the nail T at the drawing starting position β. Then, one line is drawn by moving the pen 41 in a direction indicated by an arrow (the second direction) of the moving route M4 along the extending direction L of the nail T illustrated in FIG. 6A (moved downward in FIG. 6).

The drawing control unit 815 determines whether the pen 41 draws to the end of one line (step S8).

If drawing is not finished to the end of the one line (NO in step S8), the determination is repeated.

On the other hand, in the case where the pen 41 draws to the end of one line (YES in step S8), the drawing control unit 815 determines whether drawing is finished on the entire nail T (step S9).

In the case where drawing is finished on the entire nail T (YES in step S9), a drawing process for the nail T is finished.

On the other hand, in the case where drawing is not finished on the entire nail T (NO in step S8), the drawing control unit 815 operates the motor 426 for vertically moving a pen in a lifting mechanism and moves up the pen 41 once to the height in which the pen 41 does not come into contact with a surface of the nail T (step S10).

Further, the drawing control unit 815 operates the head moving unit 49 and moves the pen 41 in the width direction W of the nail T (a right direction in FIGS. 6A and 6B in the embodiment) in directions indicated by arrows of the moving routes M2, M3, M5, and M6 along the moving routes M2, M3, M5, and M6 indicated in FIGS. 6A and 6B to a drawing starting position of a next line (the highest position on a next line in the embodiment) (step S11).

A moving level in the width direction W of the nail T is appropriately adjusted depending on such as a width of the pen tip 413.

Specifically, the drawing control unit 815 determines the moving level in the width direction W of the nail T based on information on the pen 41 stored in the pen information storage region 824.

After that, at a drawing starting position of the next line, the drawing control unit 815 operates the motor 426 for vertically moving a pen and moves down the pen 41 to a position where the pen 41 comes into contact with a surface of the nail T. Then, drawing is restarted from a drawing starting position of the next line (step S12).

The drawing control unit 815 returns to step S8 and repeats the above processes (steps S10 to S12) until drawing is completed on the entire nail T (YES in step S9).

As described above, according to the embodiment, the drawing control unit 815 draws each line by moving the pen 41, which is a drawing tool, along the extending direction L of the nail T from a drawing starting position on one end side of the width direction W of the nail T (specifically, the drawing starting position α in the painted-out drawing region Da, the drawing starting position β in the painted-out drawing region Db). After one line is drawn in the extending direction L of the nail T, the drawing control unit 815 controls the motor 426 for vertically moving a pen included in the head moving unit 49 and a lifting mechanism so as to perform operation control in which the pen 41 is moved up and moved in the width direction W of the nail T in a state in which the pen 41 is not in contact with a surface of the nail T, and drawing is restarted from a drawing starting position of a next line.

Both ends of the nail T in the width direction W are relatively low, and a center is relatively high and has a curved shape. Therefore, in the case where the pen 41 is moved in the width direction of the nail T in a state in which the pen 41 is in contact with a surface of the nail T, the nail T may feel pain when the nail T is strongly pressed by the pen 41, and the print finger U1 may move when being pushed.

In this point, in the embodiment, drawing is performed to each line along the extending direction L of the nail T, and when the pen 41 is moved in the width direction W of the nail T, the nail T is not pressed by the pen 41 on an inclined surface since the pen 41 is moved up to a position where the pen 41 does not come into contact with a surface of the nail T. Accordingly, it can be prevented that the nail T feels pain, and the print finger U1 moves. Therefore, highly precise drawing can be performed without deviation of a drawing position.

According to the embodiment, drawing is performed for each line in the extending direction L of the nail T, and the pen 41 is moved up and down and moved in the width direction W of the nail T at upper and lower ends of the line. Accordingly, even if the pen 41 is frequently moved up and down in the middle of one painted-out region (the painted-out drawing region Da and the painted-out drawing region Db in FIG. 6), a drawn image is not much affected, and nail printing with fine finish can be realized.

Before or after the painted-out region is painted out by repeatedly drawing each line in the extending direction L of the nail T (the painted-out drawing regions Da and Db in FIG. 6), an outline of each painted-out region (the painted-out drawing regions Da and Db in FIG. 6) may be drawn by the pen 41.

In this case, even if a trace of the pen 41 is left on the nail T when the pen 41 is moved up and down and moved in the width direction W of the nail T, the trace is hidden by the outline, and therefore, the nail T can be more finely finished.

Second Embodiment

A second embodiment of a nail printer (drawing device) and a drawing method for the nail printer (drawing device) according to the present invention will be described with reference to FIGS. 8 and 9.

The second embodiment is same as the first embodiment other than the procedure to paint out the painted-out region by a pen. Therefore, especially a point different from the first embodiment will be described below.

In the embodiment, as with the first embodiment, when a pen 41 draws, a drawing control unit 815 causes the pen 41 to draw each line along an extending direction of a nail T.

Figure 8:
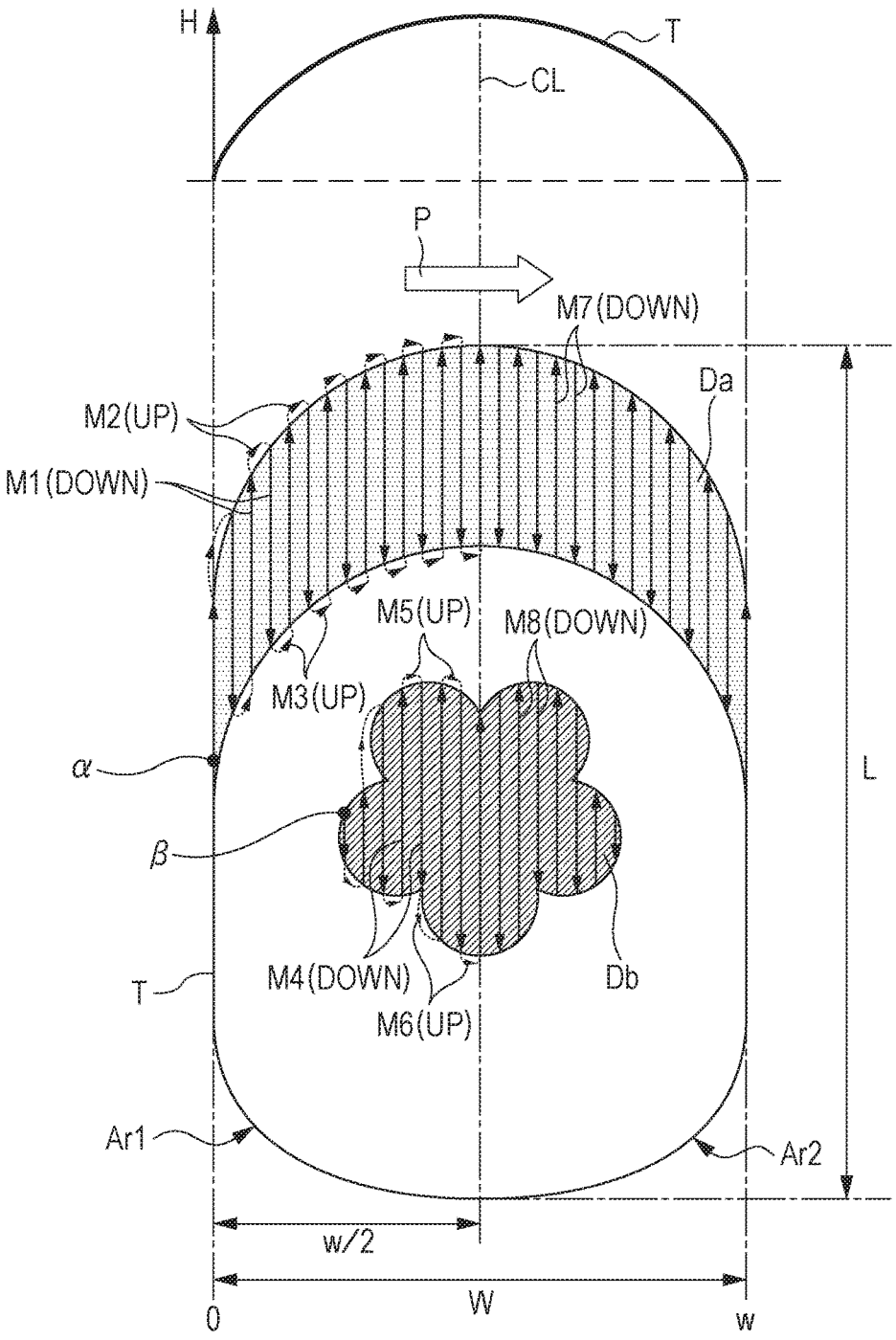
FIG. 8 is a view for describing a procedure for drawing processes according to a second embodiment.

FIG. 8 is a view for describing a procedure for drawing process by the pen 41 according to the embodiment.

In FIG. 8, a drawing direction in the embodiment is indicated by a void arrow.

As illustrated in FIG. 8, in the embodiment, a surface of the nail T (a drawing target surface) is divided into a first target region Ar1 and a second target region Ar2. The first target region Ar1 is from one end side (left side in FIG. 8) in the width direction W of the nail T to a center line CL passing a center of the width direction W of the nail T. The second target region Ar2 is from the center line CL to another end side (right side in FIG. 8) of the width direction W of the nail T.

The drawing control unit 815 performs specific operation control as in the first embodiment in a region from a drawing starting position (specifically, a drawing starting position α in a painted-out drawing region Da, a drawing starting position β in a painted-out drawing region Db) on one end side in a width direction of the nail T in the first target region Ar1 to the center line CL.

Specifically, the drawing control unit 815 performs drawing for each line by moving the pen 41 which is a drawing tool in directions (second directions) indicated by arrows of moving routes M1 and M4 along an extending direction L of the nail T from a drawing starting position on one end side in the width direction W of the nail T.

After one line is drawn in the extending direction L of the nail T, the drawing control unit 815 controls the head moving unit 49 and a lifting mechanism so as to perform operation control in which the pen 41 is moved up and moved in the width direction W of the nail T along the moving routes M2, M3, M5, M6 in a state in which the pen 41 is not in contact with a surface of the nail T, and drawing is restarted from a drawing starting position of a next line.

On the other hand, in a region from the center line CL to another end of the width direction W of the nail T in the painted-out drawing regions Da and Db in the second target region Ar2, after one line is drawn in the extending direction L of the nail T, the drawing control unit 815 moves the pen 41 which is a drawing tool in the width direction W of the nail T to a drawing starting position of a next line along a moving route M7 while contacting with the nail T and continues drawing. The drawing control unit 815 controls the head moving unit 49 and a lifting mechanism so as to continuously perform drawing Specifically, in FIG. 8, a left side end (left side in FIG. 8) in the width direction W of the nail T is an initial drawing starting position α in the painted-out drawing region Da in a tip portion of the nail T. From this position, first, the drawing control unit 815 draws one line by moving the pen 41 in a direction (second direction) of an arrow of the moving route M1 along the extending direction L of the nail T illustrated in FIG. 8 (moved upward in FIG. 8).

In the first target region Ar1, after one line is drawn, the drawing control unit 815 moves up the pen 41 once by a lifting mechanism to the height in which the pen 41 does not come into contact with a surface of the nail T. Then, the pen 41 is moved in a right direction (right direction in FIG. 8) in the width direction W of the nail T along the moving route M2, and drawing is restarted from a drawing starting position (the highest position of a next line according to the embodiment) of a next line.

Thus, regarding w/2 of the width direction W of the nail T (specifically in the first target region Ar1), the drawing control unit 815 subsequently performs operation control as in the first embodiment by moving up and down the pen 41 every time after one line is drawn in the extending direction L of the nail T.

Similarly, regarding the flower-shaped painted-out drawing region Db positioned at a substantially center of the nail T, an initial painted-out drawing region 13 is positioned on a left side (left side in FIG. 8) in the width direction W of the nail T, and one line is drawn from this position by first moving the pen 41 along the extending direction L of the nail T as indicated by a downward arrow in FIG. 8 (moved downward in FIG. 8).

In the first target region Ar1, after one line is drawn, when the drawing control unit 815 once moves up the pen 41 by a lifting mechanism to the height in which the pen 41 does not come into contact with a surface of the nail T, moves the pen 41 in a right direction (right direction in FIG. 8) in the width direction W of the nail T, and restarts drawing from a drawing starting position of a next line (the lowest position of the next line according to the embodiment).

As described above, the drawing control unit 815 subsequently performs operation control by moving up and down the pen 41 every time after one line is drawn in the extending direction L of the nail T regarding w/2 of the width direction W of the nail T.

According to the embodiment, every time after one line is drawn, the drawing control unit 815 always determines whether a present position x of the pen 41 exceeds w/2 of the width direction W (0 to W) of the nail T.

In the case where the position x of the pen 41 exceeds w/2 (x>w/2), it is determined that the present position x of the pen 41 becomes the second target region Ar2 which is from the center line CL to another end side of the width direction W of the nail T.

In the second target region Ar2, after one line is drawn in the extending direction L of the nail T, the pen 41 which is a drawing tool is not moved up and moves in the width direction W of the nail T to a drawing starting position of a next line in a state in which the pen tip 413 is in contact with the nail T, and the pen 41 continuously performs drawing.

Other configurations are same as configurations according to the first embodiment, and therefore, descriptions thereof will be omitted.

Next, a drawing method by the nail printer 1 according to the embodiment will be described with reference to FIGS. 8 and 9.

Figure 9:
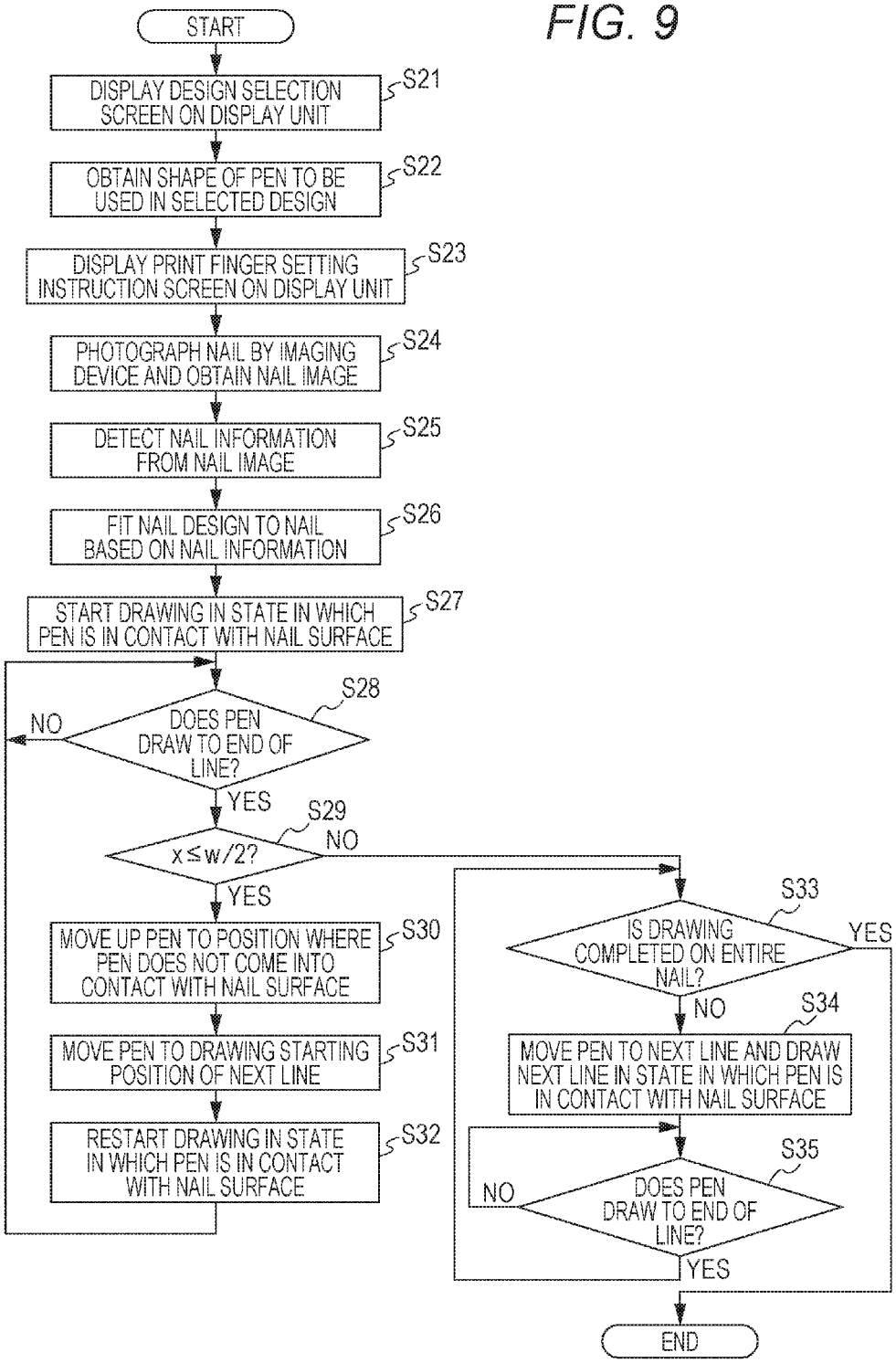
FIG. 9 is a flowchart illustrating the drawing processes according to the second embodiment.

Steps S21 to S28 in FIG. 9 are same as steps S1 to S8 in FIG. 7 according to the first embodiment, and therefore descriptions thereof will be omitted.

In the case where the drawing control unit 815 determines that the pen 41 draws to the end of one line by moving the pen 41 along the moving routes M1 and M4 (YES in step S28), the drawing control unit 815 determines whether the present position x of the pen 41 exceeds w/2 of the width direction W (0 to w) of the nail T (step S29).

In the case where the present position x of the pen 41 does not exceed w/2 of the width direction W (0 to w) of the nail T (YES in step S29), the drawing control unit 815 operates the motor 426 for vertically moving a pen in a lifting mechanism and moves up the pen 41 once to the height in which the pen 41 does not come into contact with a surface of the nail T (step S30).

Further, the drawing control unit 815 operates the head moving unit 49 and moves the pen 41 in the width direction W (a right direction in FIG. 8 according to the embodiment) of the nail T along the moving routes M2, M3, M5, and M6 to a drawing starting position of a next line (the highest position on the next line according to the embodiment) (step S31).

Then, at a drawing starting position of the next line, the drawing control unit 815 operates the motor 426 for vertically moving a pen and moves down the pen 41 to a position where the pen 41 comes into contact with a surface of the nail T. Then, drawing is restarted from a drawing starting position of the next line (step S32).

The drawing control unit 815 returns to step S28, determines whether the pen 41 draws to the end of one line, and repeats the above processes (steps S30 to S32).

On the other hand, in the case where the present position x of the pen 41 exceeds w/2 of the width direction W (0 to w) of the nail T (NO in step S29), the drawing control unit 815 determines whether drawing on the entire nail T is finished (step S33).

In the case where drawing has been finished on the entire nail T (YES in step S33), a drawing process for the nail T is finished.

On the other hand, in the case where drawing on the entire nail T is not finished (NO in step S33), the drawing control unit 815 operates the head moving unit 49, moves the pen 41, which is a drawing tool, in the width direction W of the nail T to a drawing starting position of a next line along the moving route M7 in which the pen 41 is in contact with the nail T, and continuously performs drawing (step S34).

The drawing control unit 815 determines whether the pen 41 draws to the end of one line (step S35).

If the pen 41 does not draw to the end of the one line (NO in step S35), the determination is repeated.

On the other hand, in the case where the pen 41 draws to the end of the one line (YES in step S35), the drawing control unit 815 determines whether drawing on the entire nail T is finished (step S33).

In the case where drawing has been finished on the entire nail T (YES in step S33), a drawing process for the nail T is finished.

On the other hand, in the case where drawing in the entire nail T is not finished (NO in step S33), the above steps (steps S34 and S35) are repeated until the drawing on the entire nail T is finished (YES in step S33).

Other points are same as points according to the first embodiment. Therefore, descriptions thereof will be omitted.

As described above, according to the embodiment, effects as in the first embodiment and effects to be described below can be obtained.

Specifically, in the embodiment, a surface of the nail T is divided into the first target region Ar1 from one end side of the width direction W of the nail T to the center line CL passing a center in the width direction W of the nail T and the second target region Ar2 from the center line CL to another end side of the width direction W of the nail T. In the case where the pen 41 starts drawing from one end in the width direction W of the nail T, operation control in which the pen 41 is moved up and down is performed in the first target region Ar1 to the center line CL when moving to the width direction W of the nail T, and the pen 41 is not moved up and down, and drawing is continuously performed like with a single stroke in the second target region Ar2 from the center line CL to another end side of the width direction W of the nail T.

Consequently, the pen tip 413 does not come into contact with the nail T when the pen 41 is moved in a direction climbing an inclination of the nail T from one end toward a center of the nail T, and it is prevented that the pen 41 presses the nail T.

On the other hand, if the pen 41 is moved up and down every time after the pen 41 draws one line, it takes time for drawing accordingly.

Regarding this point, in the embodiment, as described above, in the case where the pen 41 is moved in a direction descending an inclination of the nail T from a center toward another end of the nail T, the pen 41 is not moved up and down when the pen 41 is moved in the width direction W of the nail T, and the pen 41 continuously performs drawing. Thus, a drawing time can be shortened, rapid and efficient nail printing can be performed.

As described above, even if the pen 41 is not moved up and down when moving from a center to another end of the nail T, when the pen 41 is moved down in a direction descending an inclination of the nail T, the pen tip 413 is not caught by the nail T in a state in which the pen tip 413 is in contact with the nail T, and the pen 41 does not strongly push the nail T. Therefore, the nail T does not feel pain. Further, the print finger U1 does not move by being pressed by the pen 41. Therefore, highly precise nail printing can be realized.

Third Embodiment

A third embodiment of a nail printer (drawing device) and a drawing method for the nail printer (drawing device) according to the present invention will be described with reference to FIGS. 10 and 11A to 11E.

The third embodiment is same as the first and second embodiments other than a procedure to paint out a painted-out region by a pen. Therefore, especially a point different from such as the first embodiment will be described below.

In the embodiment, as with such as the first embodiment, when a pen 41 draws, a drawing control unit 815 causes the pen 41 to draw each line along an extending direction of a nail T.

Figure 10:
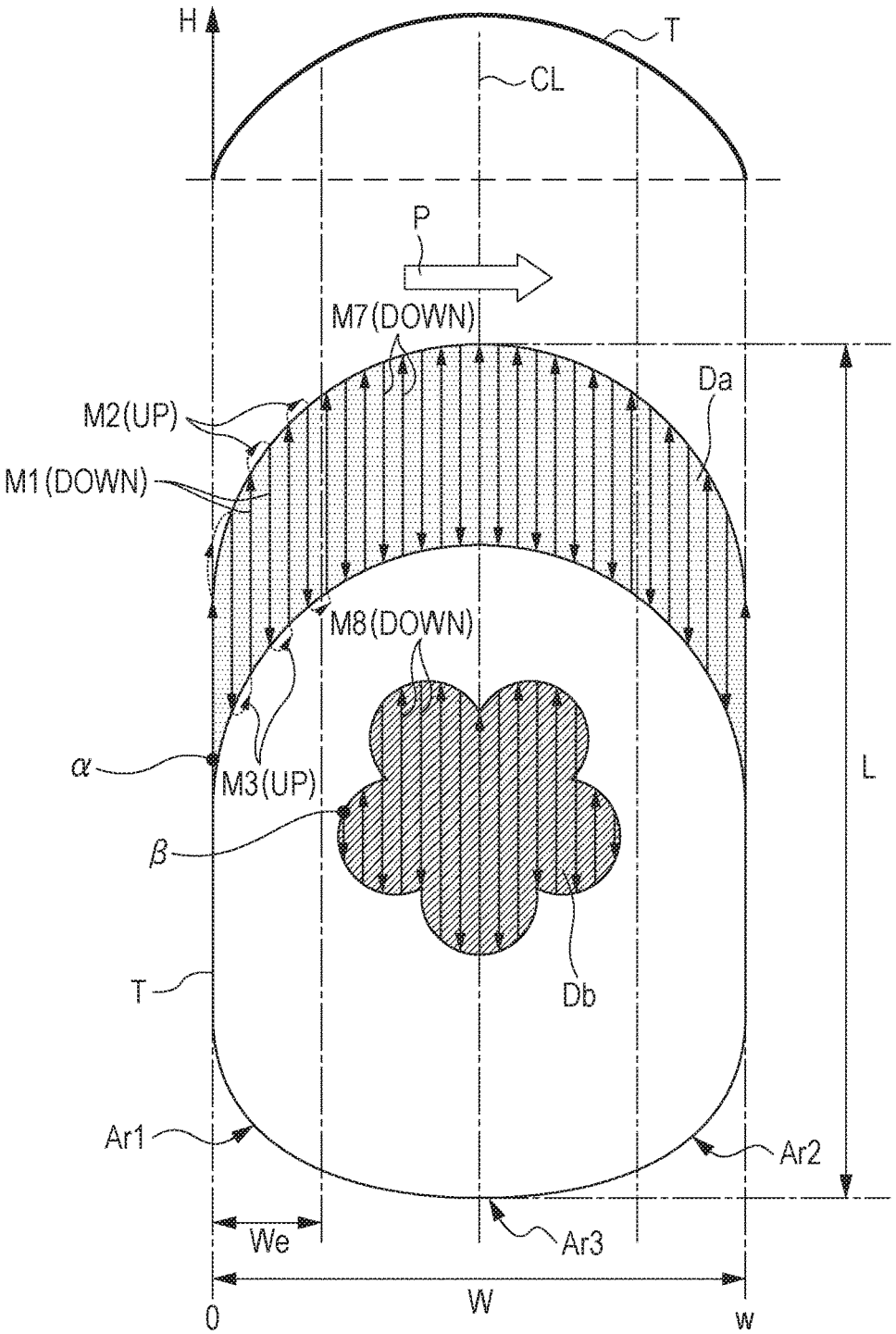
FIG. 10 is a view for describing a procedure for drawing processes according to a third embodiment.

FIG. 10 is a view for describing a procedure for a drawing process by the pen 41 according to the embodiment.

In FIG. 10, a drawing direction in the embodiment is indicated by a void arrow.

As described in FIG. 10, in the embodiment, a surface of the nail T is divided into a first target region Ar1, a second target region Ar2, and a third target region Ar3. The first target region Ar1 is on one end side in a width direction W of the nail T. The second target region Ar2 is on another end side in the width direction W of the nail T. The third target region Ar3 is sandwiched between the first target region Ar1 and the second target region Ar2.

Herein, the first target region Ar1 is a region including an edge of one end side of the nail T and provided on the one end side from the center line CL passing a center of the width direction W of the nail T according to a curved shape of the nail T.

The second target region Ar2 includes an edge of another end side of the nail T and provided on another end side from the center line CL according to a curved shape of the nail T.

The nail T is substantially symmetrical to the center in the width direction W. Therefore, the first target region Ar1 and the second target region Ar2 are provided in the substantially same width (hereinafter called a predetermined width We) on one end side and another end side in the width direction W of the nail T.

The drawing control unit 815 performs specific operation control as in the first embodiment in the first target region Ar1 in the painted-out drawing region Da when a drawing starting position is in the first target region Ar1 (specifically, a drawing starting position α in the painted-out drawing regions Da and a drawing starting position β in the painted-out drawing region Db).

Specifically, the drawing control unit 815 performs drawing for each line by moving the pen 41, which is a drawing tool, in a direction (second direction) indicated by an arrow of a moving route M1 along the extending direction L of the nail T from a drawing starting position on one end side in the width direction W of the nail T. After one line is drawn in the extending direction L of the nail T, the drawing control unit 815 controls the head moving unit 49 and a lifting mechanism so as to perform operation control in which the pen 41 is moved up and moved in the width direction W of the nail T along the moving routes M2 and M3 in a state in which the pen 41 is not in contact with a surface of the nail T, and drawing is restarted from a drawing starting position of a next line.

On the other hand, after the drawing control unit 815 finishes drawing for one line in the extending direction L of the nail T in a region in the second target region Ar2 and the third target region Ar3 in the painted-out drawing regions Da and Db, the drawing control unit 815 controls the head moving unit 49 and a lifting mechanism such that the pen 41 which is a drawing tool moves in the width direction W of the nail T to a drawing starting position of a next line along the moving route M7 in a state in which the pen 41 is in contact with the nail T and continuously performs drawing.

Specifically, in FIG. 10, a left side end (left side in FIG. 10) in the width direction W of the nail T is an initial drawing starting position α in the painted-out drawing region Da in a tip portion of the nail T. From this position, first, the drawing control unit 815 draws one line by moving the pen 41 in a direction (moved upward in FIG. 10) of an arrow of the moving route M1 along the extending direction L of the nail T illustrated in FIG. 10.

In the first target region Ar1 in the painted-out drawing region Da, after one line is drawn, the drawing control unit 815 once moves up the pen 41 by a lifting mechanism at the height in which the pen 41 does not come into contact with a surface of the nail T and moves the pen 41 in a right direction (right direction in FIG. 10) in the width direction W of the nail T along the moving route M2 and restarts drawing from a drawing starting position of a next line (the highest position of the next line according to the embodiment).

Thus, regarding the predetermined width We on one end side in the width direction W of the nail T (specifically in the first target region Ar1), the drawing control unit 815 subsequently performs operation control as in the first embodiment by moving up and down the pen 41 every time after one line is drawn in the extending direction L of the nail T.

According to the embodiment, every time after one line is drawn, the drawing control unit 815 always determines whether a present position x of the pen 41 exceeds the predetermined width We on one end side of the width direction W (0 to w) of the nail T.

Then, in the case where the position x of the pen 41 exceeds the predetermined width We (x>We), the drawing control unit 815 determines that the present position x of the pen 41 is in the third target region Ar3.

In the third target region Ar3 and the second target region Ar2 adjacent to the third target region Ar3, when one line is drawn in the extending direction L of the nail T, the pen 41 which is a drawing tool is not moved up and continuously performs drawing in a state in which the pen tip 413 is in contact with the nail T by moving in the width direction W of the nail T to a drawing starting position of a next line.

A whole of the flower-shaped painted-out drawing region Db positioned at the substantially center of the nail T including an initial drawing starting position β is disposed in the third target region Ar3. Therefore, regarding the painted-out drawing region Db, the pen 41 repeats moving in the extending direction L of the nail T and moving in the width direction W of the nail T in a state in which the pen tip 413 is in contact with the nail T and continuously performs drawing from starting drawing until finishing drawing all lines.

A width in the width direction W of the nail T (specifically the predetermined width We) in the first target region Ar1 and the second target region Ar2 is set in accordance with nail information (a curved shape of the nail T) detected by the nail information detection unit 812.

In the present embodiment, the nail T of a user is divided into five curving patterns depending on a curved shape thereof.

Such as a storage unit 82 previously stores the five curving patterns and a ratio of the predetermined width We with respect to the width direction W of the nail T corresponding each curving pattern.

When the nail information detection unit 812 obtains nail information of the nail T of the user, the control unit 81 matches a form of the nail T of a user with the five curving patterns based on the information on a nail width and a curvature of the nail T and classifies the nail T of the user into the closest curving pattern.

The classified nail T is preferably stored (registered) in the storage unit 82 by corresponding to user information. Accordingly, the same user can promptly perform nail printing on the same nail T according to the registered curving pattern, and more efficient nail printing depending on the nail T of the user can be performed.

FIGS. 11A to 11E illustrate examples of the five curving patterns and examples of a ratio of the predetermined width We with respect to the width direction W of the nail T in each curving pattern (specifically, a ratio of the predetermined width We of the first target region Ar1 and the second target region Ar2 in the case where the width direction W of the nail T is 100%).

In FIGS. 11A to 11E, FIG. 11A illustrates the nail T having the smallest curved shape (plane shape). In this case, the predetermined width We in the width direction W of the nail T in the first target region Ar1 and the second target region Ar2 is 10% of the width direction W of the nail T.

Figure 11A:
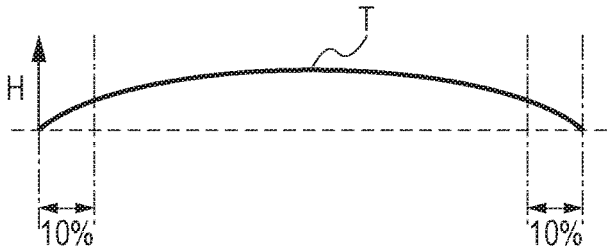
FIGS. 11A to 11E are views for describing examples of curving patterns on a nail according to the third embodiment.
Figure 11B:
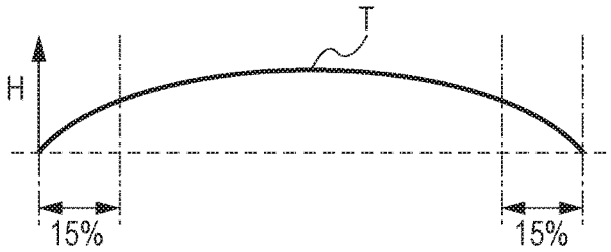
Figure 11C:
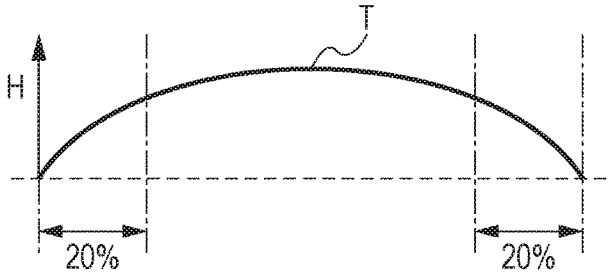
Figure 11D:
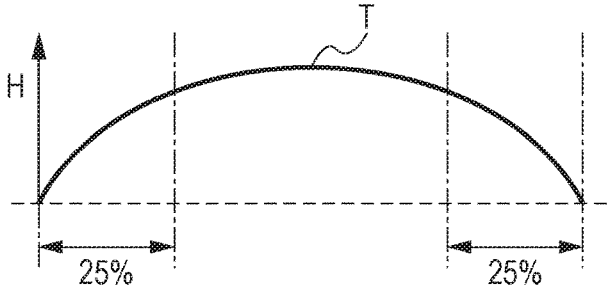
Figure 11E:
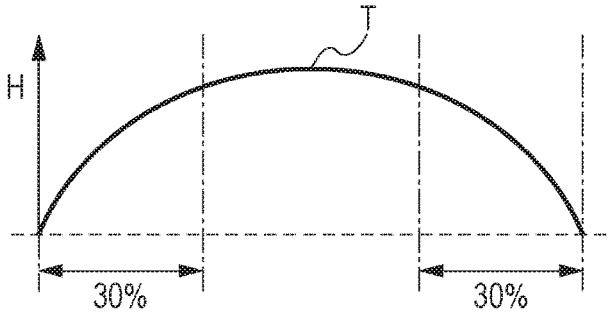

FIG. 11E illustrates the nail T having the largest curved shape (round shape). In this case, the predetermined width We in the width direction W of the nail T in the first target region Ar1 and the second target region Ar2 is 30% of the width direction W of the nail T.

FIG. 11C illustrates the nail T having a standard curved shape (standard shape). In this case, the predetermined width We in the width direction W of the nail T in the first target region Ar1 and the second target region Ar2 is 20% of the width direction W of the nail T. FIG. 10 illustrates an example of the standard type nail T, and the predetermined width We is 20% of the width direction W of the nail T.

FIG. 11B illustrates an example of a type between the plane type illustrated in FIG. 11A and the standard type illustrated in FIG. 11C. The predetermined width We in the width direction W of the nail T in the first target region Ar1 and the second target region Ar2 is 15% of the width direction W of the nail T.

FIG. 11D illustrates an example of a type between the round type illustrated in FIG. 11E and the standard type illustrated in FIG. 11C. The predetermined width We in the width direction W of the nail T in the first target region Ar1 and the second target region Ar2 is 25% of the width direction W of the nail T.

Patterns of the nail T are not limited to examples illustrated in FIGS. 11A to 11E. Patterns of the nail T may be more finely divided or may be more roughly divided, for example, into three patterns which is less than the examples illustrated in FIGS. 11A to 11E.

The predetermined width We of each pattern indicated herein is an example, and the predetermined width We is not limited thereto.

Other configurations are same as configurations according to such as the first embodiment. Therefore, descriptions thereof will be omitted.

Next, a drawing method by the nail printer 1 according to the embodiment will be described with reference to FIG. 10.

In the embodiment, before starting drawing, the nail T of a user is classified into any of the five curving patterns depending on a curved shape thereof based on the nail information obtained by the nail information detection unit 812, and a surface of the nail T is divided into the first target region Ar1, the second target region Ar2, and the third target region Ar3 according to the predetermined width We set for each pattern.

For example, in the case where the nail T of a user is classified into a standard type (refer to FIG. 11C), the predetermined width We is 20% of the width direction W of the nail T. The first target region Ar1 is a region from one end side of the nail T to 20% in the width direction W of the nail T. The second target region Ar2 is a region from another end side of the nail T to 20% in the width direction W of the nail T. A region sandwiched between the first target region Ar1 and the second target region Ar2 is the third target region Ar3.

When the pen 41 draws from a drawing starting position to the end of one line, the drawing control unit 815 determines whether the present position x of the pen 41 exceeds the predetermined width We of the width direction W of the nail T.

In the case where the present position x of the pen 41 is not exceeding the predetermined width We of the width direction W (0 to w) of the nail T, the drawing control unit 815 operates the motor 426 for vertically moving a pen in a lifting mechanism and moves up the pen 41 once to the height in which the pen 41 does not come into contact with a surface of the nail T.

Further, the drawing control unit 815 operates the head moving unit 49 and moves the pen 41 in the width direction W of the nail T (a right direction in FIG. 10 in the embodiment) to a drawing starting position of a next line (the highest position on a next line in the embodiment). After that, at a drawing starting position of the next line, the drawing control unit 815 operates the motor 426 for vertically moving a pen, moves down the pen 41 to a position where the pen 41 comes into contact with a surface of the nail T, and restarts drawing from the drawing starting position of the next line. The drawing control unit 815 further determines whether the pen 41 draws to an end of the one line and repeats the same processes.

On the other hand, in the case where the present position x of the pen 41 is exceeding the predetermined width We of the width direction W (0 to w) of the nail T, the drawing control unit 815 determines whether drawing on the entire nail T is finished. If the drawing is finished, the drawing process for the nail T is finished.

On the other hand, in the case where drawing on the entire nail T is not finished, the drawing control unit 815 operates the head moving unit 49 and continuously performs drawing by moving the pen 41 to another end side of the nail T, which is a drawing tool, in the width direction W of the nail T to a drawing starting position of a next line in a state in which the pen 41 is in contact with the nail T.

In the case where drawing is performed to an end of a next one line, the drawing control unit 815 determines whether drawing on the entire nail T is finished, and in the case where the drawing is finished, the drawing process for the nail T is finished.

In the case where drawing on the entire nail T is not finished, the same process is repeated until drawing on the entire nail T is finished.

Other points are same as points in such as the first embodiment. Therefore, descriptions thereof will be omitted.

As described above, according to the embodiment, effects as in the first embodiment and effects to be described below can be obtained.

Specifically, in the embodiment, a surface of the nail T is divided into the first target region Ar1, the second target region Ar2, and the third target region Ar3 depending on a curved shape of the nail T. The first target region Ar1 is on one end side in the width direction W of the nail T. The second target region Ar2 is on another end side in the width direction W of the nail T. The third target region Ar3 is sandwiched between the first target region Ar1 and the second target region Ar2.

The drawing control unit 815 performs the above operation control in the first target region Ar1 when a drawing starting position is in the first target region Ar1 (specifically, a drawing starting position α in the painted-out drawing regions Da and a drawing starting position β in the painted-out drawing region Db). On the other hand, in the second target region Ar2 and the third target region Ar3, after one line is drawn in the extending direction L of the nail T, drawing is continuously performed, by the drawing control unit 815, by moving the pen 41, which is a drawing tool, in the width direction W of the nail T to a drawing starting position of a next line in a state in which the pen 41 is in contact with the nail T.

Accordingly, a region in which the above specific operation control is performed can be minimized in accordance with a shape of the nail T of a user, and more rapid and efficient nail printing can be realized by further shortening a drawing time.

Although the embodiments according to the present invention have been described above, the present invention is not limited to the embodiments and can be variously changed within the scope of the gist thereof.

For example, in the third embodiment, an example is described in which a width in the width direction W of the nail T (specifically the predetermined width We) in the first target region Ar1 and the second target region Ar2 is set according to nail information (a curved shape of the nail T) detected by the nail information detection unit 812. However, a point to be considered when the predetermined width We is set is not limited a curved shape of the nail T. For example, the predetermined width We may be set according to a length in the width direction W of the nail T.

In the above embodiments, an example is described in which information on the pen 41 is registered by manual input by a user or automatic input by reading such as a bar cord and stored in the pen information storage region 824. However, the information on the pen 41 may not be registered.

For example, in the case where image data of a nail design includes information on the pen 41 to be used for drawing the design (for example, the shape and the width of the pen tip 413, and an ink type), the information on the pen 41 may not be separately stored in such as the storage unit 82.

In each embodiment, an example is described in which the drawing head 43 includes one pen holder 42. However, the pen holder 42 provided to the drawing head 43 is not limited to one.

For example, a plurality of the pen holders 42 is included and a plurality of the pens 41 for drawing may be held.

In each embodiment, an example is described in which the pen 41 held by the pen holder 42 is manually exchanged by a user as necessary.

However, for example, a standby space for waiting the pen 41 is provided in such as the home area 60, and a pen exchange mechanism (not illustrated) may automatically obtain the needed pen 41 from the standby space and exchange the pen 41 held in the pen holder 42.

In each embodiment, an example is described in which the drawing head 43 includes the imaging device 51 and the lighting device 52. However, positions in which the imaging device 51 and the lighting device 52 are provided are not limited thereto.

For example, the imaging device 51 and the lighting device 52 are fixedly arranged on a ceiling of the nail printer 1. In this case, nail images to detect a shape and a curvature of the nail T as nail information are imaged from different positions and angles, and therefore, a plurality of the imaging devices 51 are preferably provided at different positions.

In each embodiment, an example is described in which such as a curvature of the nail T is detected as nail information, and image data is generated based on the information. However, detecting such as a curvature of the nail T is not an essential component in the present invention.

For example, such as in the case where a one point design is drawn at a center of the nail T, if it is sufficient to know an approximate position on the nail T to be drawn, a shape and a curvature of the nail T may not be precisely recognized, and drawing can be performed without detecting such as a nail shape.

In each embodiment, as an example, the nail printer 1 is described which subsequently performs drawing by inserting fingers one by one. However, the present invention can be applied to a device which can continuously performs drawing and removes ink without inserting and pulling out each finger with respect to a plurality of fingers.

For example, by increasing a drawable range by widening a pen movable range, drawing can be continuously performed on each finger nail and ink can be removed in a state in which a plurality of the print fingers U1 is inserted at the same time.

Embodiments according to the present invention have been described above. However, a scope of the present invention is not limited to the above-described embodiments, and the scope of the present invention described in claims and a scope equivalent thereto are included.

What is claimed is:

1. A drawing device, comprising:

a drawing unit which holds a drawing tool for drawing on a drawing target surface in contact with the drawing target surface and moves the drawing tool; and a control unit which controls the drawing unit, wherein:

the drawing target surface has a curved shape along a first direction, the control unit controls the drawing unit to move the drawing tool to draw a plurality of lines in at least one drawing region on the drawing target surface, the plurality of lines are adjacent to each other, are at least partially in contact with each other in the first direction, and extend in a second direction which crosses the first direction, the drawing unit is operable to set the drawing tool in a first state in which the drawing tool is in contact with the drawing target surface and a second state in which the drawing tool is separated from the drawing target surface, and the control unit controls the drawing unit to:

set the drawing tool in the first state at a start point position of a first line among the plurality of the lines in the drawing region, and move the drawing tool, while the drawing tool is in the first state, along the second direction from the start point position of the first line to an end point position of the first line in the drawing region, so as to draw the first line, set the drawing tool in the second state after drawing the first line, and move the drawing tool, while the drawing tool is in the second state, from the end point position of the first line to a start point position of a second line among the plurality of lines in the drawing region, the second line being adjacent to the first line and at least partially in contact with the first line, and set the drawing tool in the first state at the start point position of the second line and move the drawing tool, while the drawing tool is in the first state, along the second direction from the start point position of the second line to an end point position of the second line in the drawing region, so as to draw the second line.

2. The drawing device according to claim 1, wherein:

the drawing target surface is a surface a nail of a finger or a toe, and the first direction is a width direction of the nail, and the curved shape of the drawing target surface is convexly curved along the first direction.

3. The drawing device according to claim 1, wherein:

the control unit divides the drawing target surface into a first target region and a second target region, the first target region is a region from a first end in the first direction on the drawing target surface to a center line passing through a center in the first direction on the drawing target surface and the second target region is a region from the center line to a second end in the first direction in the drawing target surface, and in a case where the control unit performs the drawing on the drawing target surface in a direction from a side of the first end toward a side of the second end in the first direction on the drawing target surface, (A) the control unit controls the drawing unit such that a first operation in which the drawing tool draws the first and second lines while the drawing tool is set in the first state and a second operation in which the drawing tool is moved from the end point position of the first line to the start point position of the second line while the drawing tool is set in the second state are performed by the drawing unit in the first target region, and (B) the control unit controls the drawing unit such that the second operation is not performed in the second target region.

4. The drawing device according to claim 1, wherein:

the control unit divides the drawing target surface into a first target region, a second target region, and a third target region, the first target region is a region on a first end side in the first direction on the drawing target surface, the second target region is a region on a second end side in the first direction in the drawing target surface, and the third target region is a region sandwiched between the first target region and the second target region, the first target region includes an edge on the first end side in the drawing target surface and is provided on first one end side from a center line passing through a center in the first direction in the drawing target surface, the second target region includes an edge on the second end side in the drawing target surface and is provided on the second end side from the center line, and in a case where the control unit performs the drawing on the drawing target surface in a direction from the first end side toward the second end side in the first direction on the drawing target surface, (A) the control unit controls the drawing unit such that the drawing unit performs a first operation in which the drawing tool draws the first and second lines while the drawing tool is set in the first state and a second operation in which the drawing tool is moved from the end point position of the first line to the start point position of the second line while the drawing tool is set in the second state in the first target region, and (B) the control unit controls the drawing unit such that the second operation is not performed in the second target region and the third target region.

5. The drawing device according to claim 4, wherein the control unit obtains information on a curving level of the curved shape in the drawing target surface based on an image obtained by imaging the drawing target surface, and the control unit determines, based on the obtained information on the curving level of the drawing target surface, a value of a width along the first direction from an end on the first end side in the first direction in the drawing target surface in the first target region and a value of a width along the first direction from an end of the second end side in the first direction in the drawing target surface in the second target region.

6. A drawing method for a drawing device, the drawing device including a drawing unit which holds a drawing tool for drawing on a drawing target surface in contact with the drawing target surface and moves the drawing tool, wherein (i) the drawing target surface has a curved shape along a first direction, (ii) the drawing target surface has at least one drawing region in which the drawing tool draws a plurality of lines which are adjacent to each other, at least partially in contact with each other in the first direction, and extend in a second direction which crosses the first direction, and (iii) the drawing unit is operable to set the drawing tool in a first state in which the drawing tool is in contact with the drawing target surface and a second state in which the drawing tool is separated from the drawing target surface, the drawing method comprising:

performing a first operation which comprises setting the drawing tool in the first state at a start point position of a first line among the plurality of the lines in the drawing region, and moving the drawing tool, while the drawing tool is in the first state, along the second direction from the start point position of the first line to an end point position of the first line in the drawing region, so as to draw the first line;

performing a second operation which comprises setting the drawing tool in the second state after drawing the first line, and moving the drawing tool, while the drawing tool is in the second state, from the end point position of the first line to a start point position of a second line among the plurality of lines in the drawing region, the second line being adjacent to the first line and at least partially in contact with the first line; and performing a third operation which comprises setting the drawing tool in the first state at the start point position of the second line and moving the drawing tool, while the drawing tool is in the first state, along the second direction from the start point position of the second line to an end point position of the second line in the drawing region, so as to draw the second line.

7. The drawing method for the drawing device according to claim 6, further comprising dividing the drawing target surface into a first target region and a second target region, wherein:

the first target region is a region from a first end in the first direction on the drawing target surface to a center line passing through a center in the first direction on the drawing target surface and the second target region is a region from the center line to a second end in the first direction in the drawing target surface, and in a case where the drawing tool performs the drawing on the drawing target surface in a direction from a side of the first end toward a side of the second end in the first direction on the drawing target surface, (A) the first operation, the second operation, and the third operation are performed in the first target region, and (B) the second operation is not performed in the second target region.

8. The drawing method for the drawing device according to claim 6, further comprising dividing the drawing target surface into a first target region, a second target region, and a third target region, wherein:

the first target region is a region on a first end side in the first direction on the drawing target surface, the second target region is a region on a second end side in the first direction in the drawing target surface, and the third target region is a region sandwiched between the first target region and the second target region, the first target region includes an edge on the first end side in the drawing target surface and is provided on the first end side from a center line passing through a center in the first direction in the drawing target surface, the second target region includes an edge on the second end side in the drawing target surface and is provided on the second end side from the center line in the drawing target surface, and in a case where the drawing tool performs the drawing on the drawing target surface in a direction from the first end side toward the second end side in the first direction in the drawing target surface, (A) the first operation, the second operation, and the third operation are performed in the first target region, and (B) the second operation is not performed in the second target region and the third target region.

* * * * *